US011577531B2

(12) United States Patent
Iwamoto et al.

(10) Patent No.: US 11,577,531 B2
(45) Date of Patent: Feb. 14, 2023

(54) PRINTING DEVICE PERFORMING POSITIONING OF ROTARY BODY BASED ON DETECTION RESULTS FROM TWO DETECTORS

(71) Applicant: BROTHER KOGYO KABUSHIKI KAISHA, Nagoya (JP)

(72) Inventors: Masashi Iwamoto, Nagoya (JP); Feng Zhu, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/210,257

(22) Filed: Mar. 23, 2021

(65) Prior Publication Data

US 2021/0300078 A1 Sep. 30, 2021

(30) Foreign Application Priority Data

Mar. 30, 2020 (JP) ..... JP2020-061328

(51) Int. Cl.
*B41J 3/407* (2006.01)
*B41J 11/66* (2006.01)

(52) U.S. Cl.
CPC ..... *B41J 11/663* (2013.01); *B41J 3/4075* (2013.01)

(58) Field of Classification Search
CPC ..... B41J 3/4075; B41J 11/66; B41J 11/663; B41J 11/70
See application file for complete search history.

(56) References Cited

U.S. PATENT DOCUMENTS

2015/0084262 A1* 3/2015 Sago ..... B41J 11/703 270/1.01
2019/0299668 A1 10/2019 Mizutani
2021/0039405 A1* 2/2021 Tokuda ..... B41J 11/663

FOREIGN PATENT DOCUMENTS

JP 2002254385 A * 9/2002
JP 2015-85507 A 5/2015
JP 2019-171551 A 10/2019

OTHER PUBLICATIONS

Mizuuchi, MachineTranslationofJP-2002254385-A, 2002 (Year: 2002).*

* cited by examiner

*Primary Examiner* — Scott A Richmond
(74) *Attorney, Agent, or Firm* — Kenealy Vaidya LLP

(57) ABSTRACT

A printing device includes: a motor; a rotary body driven by the motor to rotate; a movable blade driven by rotation of the rotary body to cut a printing tape; a gear mechanism provided on a power transmission path from the motor to the movable blade; a first detector outputting a first signal based on a rotated position of the rotary body; a second detector outputting a second signal based on the rotated position, and a controller performing positioning the rotary body to a predetermined reference rotated position. The positioning includes: starting rotating the rotary body in one direction on the basis of the first signal at the time of starting the positioning; halting the rotation in the one direction of the rotary body on the basis of the second signal; and rotating the rotary body in the opposite direction for a prescribed time period after the halting is completed.

9 Claims, 25 Drawing Sheets

HALF CUTTER (START OF HALF CUT)

HALF CUTTER (COMPLETION OF HALF CUT)

PRINTING DEVICE PERFORMING POSITIONING OF ROTARY BODY BASED ON DETECTION RESULTS FROM TWO DETECTORS

CROSS REFERENCE TO RELATED APPLICATION

This application claims priority from Japanese Patent Application No. 2020-061328 filed Mar. 30, 2020. The entire content of the priority application is incorporated herein by reference.

TECHNICAL FIELD

The present disclosure relates to a printing device.

BACKGROUND

Japanese Patent Application Publication No. 2015-85507 describes a tape printing device provided with a cutting mechanism for cutting tape after printing is completed, a common cutter motor for driving the cutting mechanism, and a gear mechanism for transmitting the drive force from the common cutter motor to the cutting mechanism. The cutting mechanism includes a common cam plate, a half-cutting mechanism, and a full-cutting mechanism. The common cutter motor generates a drive force and the gear mechanism transmits the generated drive force to the cam plate, thereby driving the cam plate to rotate. When the cam plate is rotated in one direction from a reference rotated position, the cam plate drives a movable blade of the half-cutting mechanism to pivot. When the cam plate is rotated in the opposite direction, the cam plate drives a movable blade of the full-cutting mechanism to pivot. Two peripheral edge cams are provided on the cam plate. Through a combination of detection values from two detection sensors that are displaced by these peripheral edge cams, the rotated position of the cam plate and the operating state of the cutting mechanism can be determined.

SUMMARY

In order to reset the overall operating state of the cutting mechanism at such times as when the power is turned on, the conventional technology described above must perform sequence control for setting the rotated position of the cam plate to the reference rotated position while referencing the detection values from the two detection sensors. However, if the detection sensors malfunction for any reason and the device performs the resetting sequence control described above without this knowledge, the motor could be driven beyond the advancing or retracting limits of the cutting mechanism, which could adversely affect the durability of the gear mechanism.

In view of the foregoing, it is an object of the present disclosure to provide a printing device capable of improving the durability of a gear mechanism.

In order to attain the above and other objects, according to one aspect, the present disclosure provides a printing device including a printing unit, a motor, a rotary body, one or more movable blades, a gear mechanism, a first detector, a second detector, and a controller. The printing unit is configured to print on a printing tape conveyed along a conveying path. The motor is configured to generate a rotational drive force. The rotary body is rotatable both in a first rotating direction and a second rotating direction opposite to the first rotational direction. The rotary body is configured to be rotated by the rotational drive force generated by the motor. The rotary body includes a first portion and a second portion. The one or more movable blades are configured to advance and retract relative to the printing tape on the conveying path in accordance with rotation of the rotary body to cut at least part of the printing tape. The gear mechanism is provided on a power transmission path of the rotational drive force from the motor to the one or more movable blades to transmit the rotational drive force. The first detector is configured to contact and separate from the first portion of the rotary body in accordance with the rotation of the rotary body to output a detection signal based on a rotated position of the rotary body. The second detector is configured to contact and separate from the second portion of the rotary body in accordance with the rotation of the rotary body to output a detection signal based on the rotated position of the rotary body. The controller is configured to perform, by controlling the motor, positioning the rotary body to a predetermined reference rotated position on the basis of the detection signals from both the first detector and the second detector. The positioning includes: (a) starting rotating the rotary body in the first rotating direction on the basis of the detection signal from one detector of the first detector and the second detector at the time of starting the positioning; (b) halting the rotation in the first rotating direction of the rotary body on the basis of the detection signal from the other detector of the first detector and the second detector; and (c) rotating the rotary body in the second rotating direction for a prescribed period of time after the rotation in the first rotating direction of the rotary body is halted by the halting in (b).

According to another aspect, the present disclosure provides a printing device including a printing unit, a motor, a rotary body, a first movable blade, a second movable blade, a gear mechanism, a first detector, a second detector, and a controller. The printing unit is configured to print on a printing tape conveyed along a conveying path. The motor is configured to generate a rotational drive force. The rotary body is rotatable both in a first rotating direction and a second rotating direction opposite to the first rotational direction. The rotary body is configured to be rotated by the rotational drive force generated by the motor. The rotary body includes a first portion and a second portion. The first movable blade is configured to advance and retract relative to the printing tape on the conveying path in accordance with rotation of the rotary body to cut at least part of the printing tape. When the rotary body is rotated in the first rotating direction from a predetermined reference rotated position for a first prescribed period of time by the rotational drive force of the motor, the first movable blade advances relative to the printing tape to start cutting the at least part of the printing tape. The second movable blade is configured to advance and retract relative to the printing tape on the conveying path in accordance with the rotation of the rotary body to cut at least part of the printing tape. When the rotary body is rotated in the second rotating direction from the predetermined reference rotated position for a second prescribed period of time by the rotational drive force of the motor, the second movable blade advances relative to the printing tape to start cutting the at least part of the printing tape. The gear mechanism is provided on a power transmission path of the rotational drive force from the motor to both the first movable blade and the second movable blade to transmit the rotational drive force. The first detector is configured to: contact and separate from the first portion of the rotary body in accordance with the rotation of the rotary body to output a detection signal based on a rotated position of the rotary body; and change polarity of the detection signal of the first detector in response to at least one of arrival of the rotary body at a first specific rotated position and arrival of the rotary body at a second specific rotated position. The first specific rotated position is the rotated position that corresponds to a timing at which cutting of the at least part of the printing tape is started by the first movable blade. The second specific rotated position is the rotated position that corresponds to a timing at which cutting of the at least part of the printing tape is started by the second movable blade. The second detector configured to: contact and separate from the second portion of the rotary body in accordance with the rotation of the rotary body to output a detection signal based on the rotated position of the rotary body; and change polarity of the detection signal of the second detector in response to arrival of the rotary body at the predetermined reference rotated position. The controller is configured to perform, by controlling the motor, positioning the rotary body to the predetermined reference rotated position on the basis of the detection signals from both the first detector and the second detector. The positioning includes: (a) starting rotating the rotary body in the first rotating direction on the basis of the detection signal from the second detector at the time of starting the positioning; (b) halting the rotation in the first rotating direction of the rotary body in response to detecting change of the polarity of the detection signal from the first detector without detecting change of the polarity of the detection signal from the second detector after the rotation in the first rotating direction of the rotary body is started by the starting in (a); and (c) rotating the rotary body in the second rotating direction for a third prescribed period of time after the rotation in the first rotating direction of the rotary body is halted by the halting in (b). The third prescribed period of time is longer than or equal to the first prescribed period of time.

BRIEF DESCRIPTION OF THE DRAWINGS

The particular features and advantages of the embodiment (s) as well as other objects will become apparent from the following description taken in connection with the accompanying drawings, in which.

DETAILED DESCRIPTION

Figure 1:
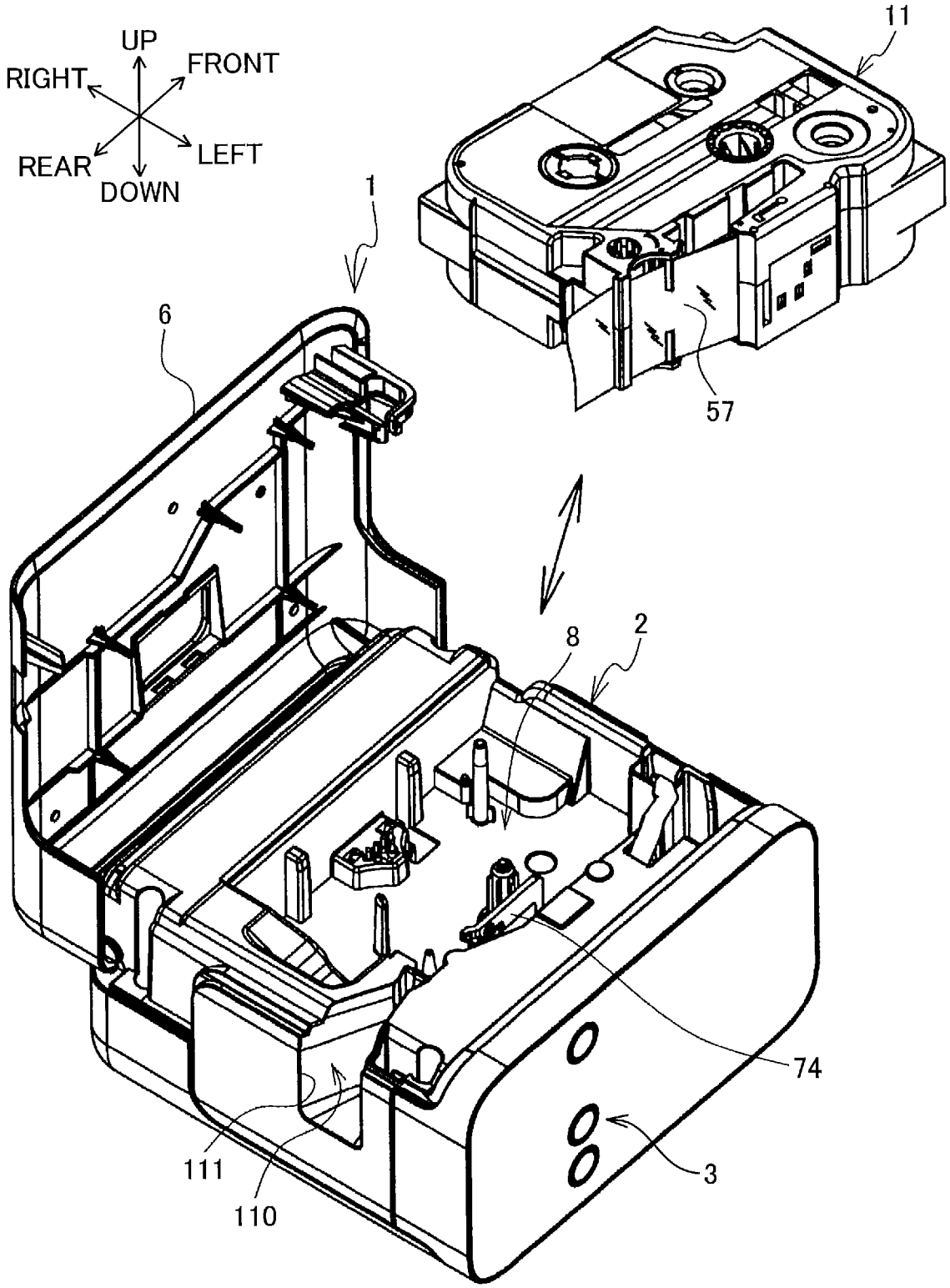
FIG. 1 is a perspective view of a printing device according to one embodiment of the present disclosure and a tape cassette.

Next, a printing device 1 according to one embodiment of the present disclosure will be described while referring to the accompanying drawings. In the following description, the front, rear, left, right, top, and bottom of the printing device 1 will correspond to the directions of the arrows indicated in FIG. 1 and other drawings.

<Mechanical Structure of the Printing Device>

The mechanical structure of the printing device 1 will be described with reference to FIG. 1. A tape cassette 11 that accommodates a tape 57 is replaceably mounted in the printing device 1, and the printing device 1 prints on the tape 57. The printing device 1 is provided with a housing 2. The housing 2 has a general rectangular parallelepiped shape. The housing 2 is provided with a cassette holder 8 in which the tape cassette 11 is detachably mountable. Switches 3 are provided on the left surface of the housing 2 for operating the printing device 1.

A cassette cover 6 is provided on the top side of the housing 2. The cassette cover 6 is opened and closed when replacing the tape cassette 11. The cassette cover 6 has a general rectangular shape in a plan view and is rotatably supported by shafts provided on the right end of the housing 2 at respective front and rear sides. FIG. 1 illustrates the cassette cover 6 in the open state. LEDs 4 (see FIG. 14) are provided on the cassette cover 6. The LEDs 4 can be lit or flashed.

Figure 2:
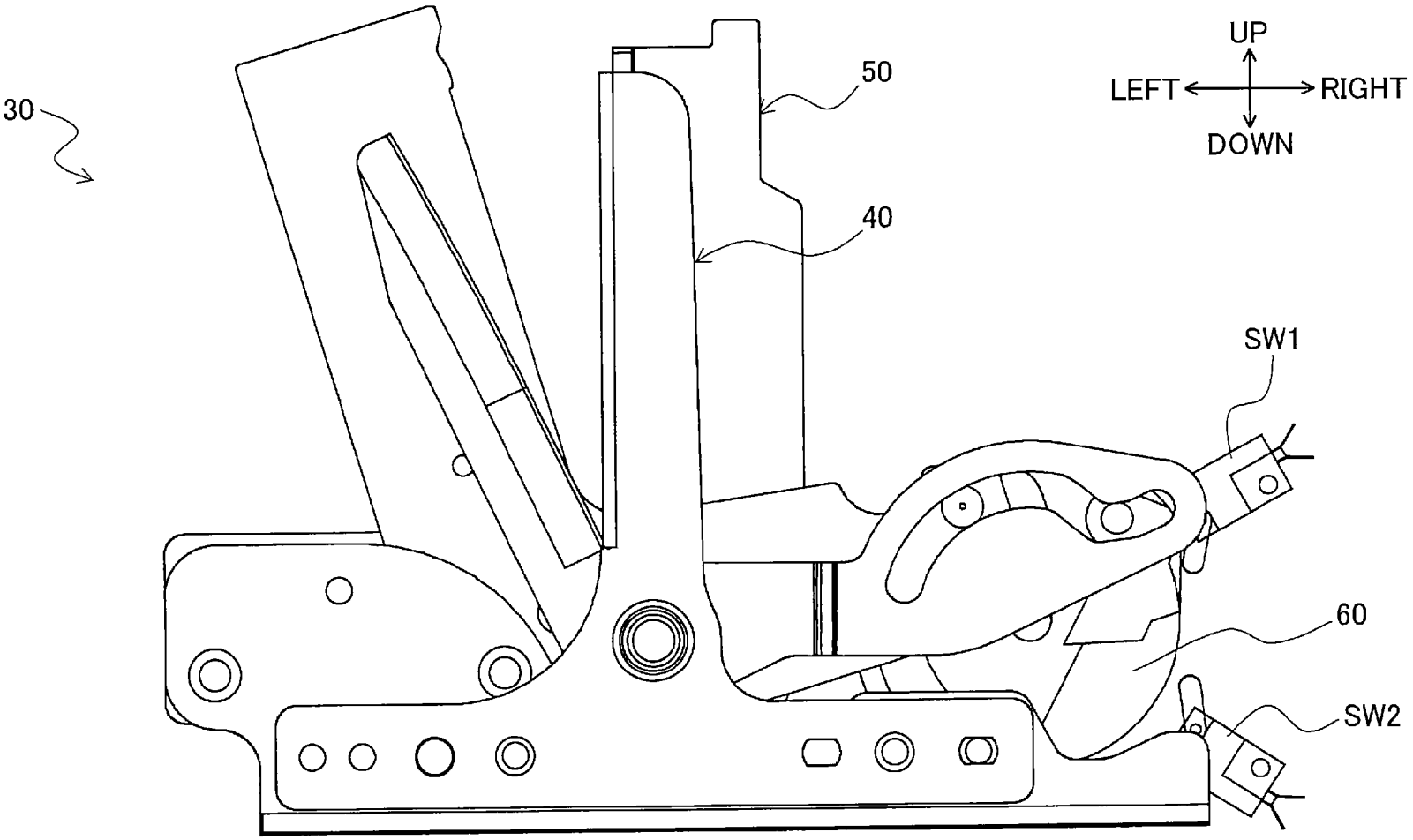
FIG. 2 is a front view of a cutter mechanism of the printing device.

A tape outlet 111 is formed in the rear surface of the housing 2. The tape outlet 111 and cassette holder 8 are in communication with each other through a tape discharge section 110. The tape discharge section 110 forms a path for conveying printed tape 57. The tape outlet 111 is an opening for discharging the tape 57 from the cassette holder 8 via the tape discharge section 110 after the tape 57 has been printed. A cutting mechanism 30 (see FIG. 2) for cutting the printed tape 57 is provided in the housing 2 between the tape outlet 111 and the cassette holder 8. The cutting mechanism 30 will be described later.

As illustrated in FIG. 1, a head holder 74 is disposed upright in the left portion of the cassette holder 8. A thermal head 10 (see FIG. 14) is provided on the left surface of the head holder 74. A platen roller (not illustrated) is rotatably supported on the left side of the thermal head 10. The platen roller is capable of contacting and separating from the thermal head 10. A tape drive motor 26 (see FIG. 14) is disposed beneath the cassette holder 8. The tape drive motor 26 is a stepping motor. The thermal head 10 is an example of the claimed "printing unit".

While not illustrated in detail, the tape 57 accommodated in the tape cassette 11 has a printable base, and an adhesive tape. The printable base is a clear film tape formed in a long strip. One surface of the printable base serves as the printing surface on which the printing device 1 prints. The adhesive tape is bonded to the printing surface of the printable base. The adhesive tape has a first adhesive layer, a background base, a second adhesive layer, and a release paper. The first adhesive layer is disposed between the background base and the printable base. The second adhesive layer is disposed between the background base and the release paper. More specifically, the first and second adhesive layers are formed by applying adhesive material to both surfaces of the background base. Thus, the tape 57 is constituted by a plurality of layers. The tape 57 is an example of the claimed "printing tape".

<Detailed Description of the Cutting Mechanism>

Figure 25:
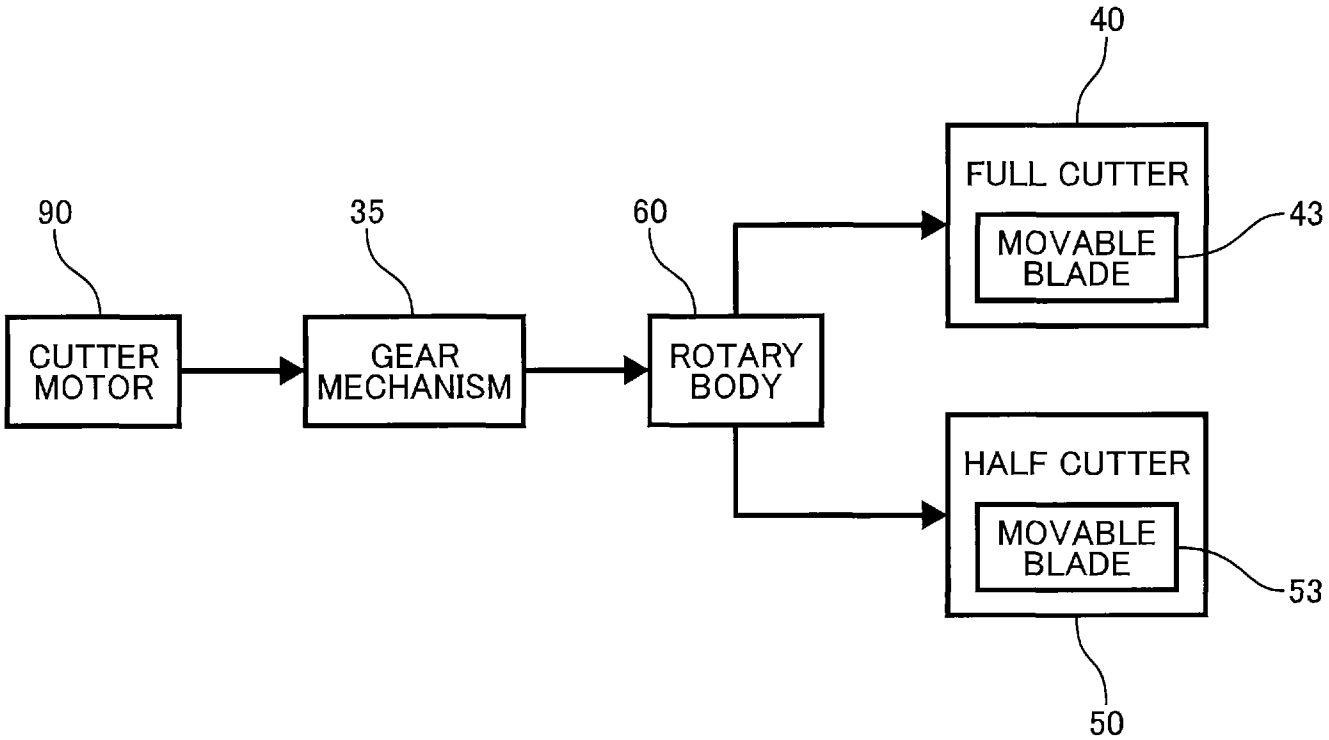
FIG. 25 is a block diagram schematically illustrating a power transmission path from a cutter motor to both the full cutter and the half cutter in the printing device.

The structure of the cutting mechanism 30 will be described with reference to FIGS. 2 through 13. The cutting mechanism 30 is a mechanical portion driven by the rotational drive force of a cutter motor 90 (see FIG. 14). FIG. 25 is a block diagram schematically illustrating the power transmission path from the cutter motor 90 to movable blades 43 and 53 described later. The gear mechanism is provided on the power transmission path and the arrows appearing in FIG. 25 indicate the transmission route of the rotational drive force of the cutter motor 90. The rotational drive force is transmitted to the cutting mechanism 30 via a gear mechanism 35, as illustrated in FIG. 25. The cutter motor 90 is an example of the claimed "motor".

The cutting mechanism 30 includes a full cutter 40, a half cutter 50, a rotary cam 60, and two detection sensors SW1 and SW2. The full cutter 40, half cutter 50, rotary cam 60, and detection sensors SW1 and SW2 all have a general flat plate-shape with prescribed thicknesses in the front-rear direction. The full cutter 40, rotary cam 60, and half cutter 50 are arranged to overlap each other in the given order from the near side (front side) to the far side (rear side) in FIG. 2. Additionally, the two detection sensors SW1 and SW2 are arranged around the periphery of the rotary cam 60. The rotary cam 60 is an example of the claimed "rotary body".

Figure 3A:
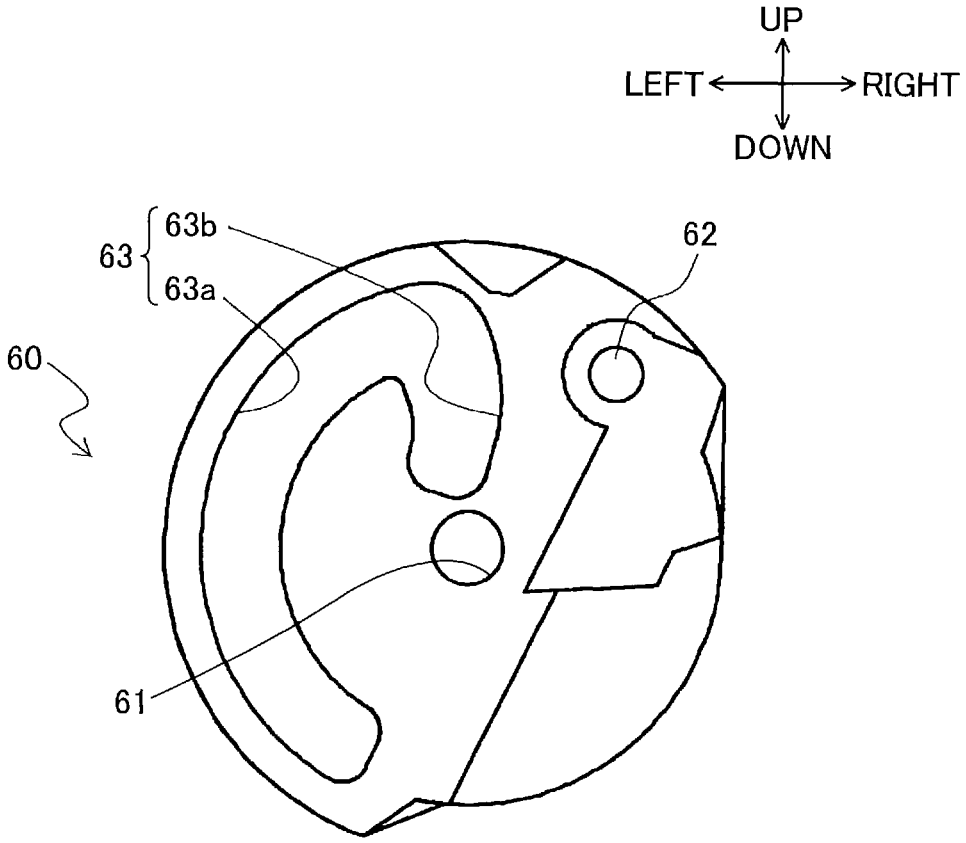
FIG. 3A is a front view of a rotary cam of the printing device.
Figure 3B:
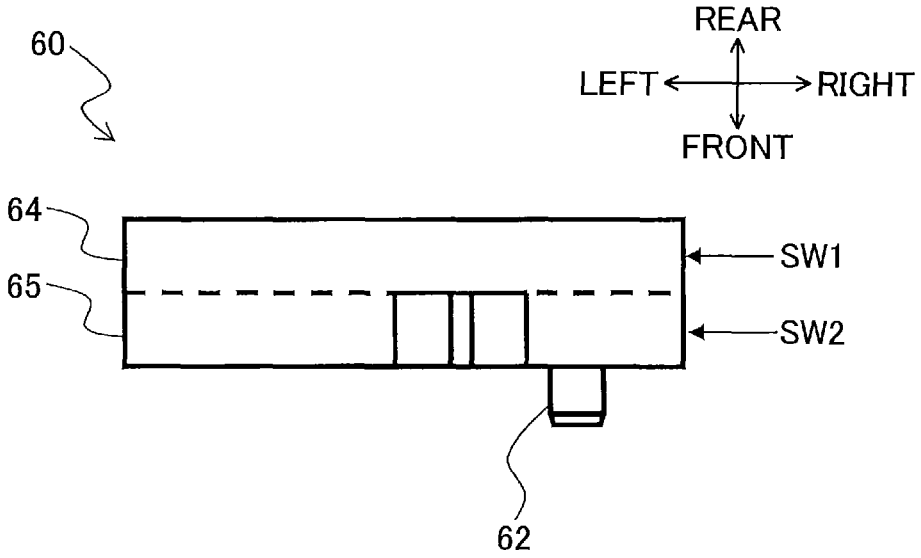
FIG. 3B is a plan view of the rotary cam.

FIG. 3A is a front view and FIG. 3B is a plan view of the rotary cam 60. As illustrated in FIG. 3A, a drive hole 61 is formed in the center of the rotary cam 60 in the front view. The drive hole 61 penetrates the rotary cam 60 in the front-rear direction. The rotary cam 60 has a general circular plate-shape with the drive hole 61 corresponding to its central axis. An engaging pin 62 is provided near the outer circumferential edge of the rotary cam 60 on the front side thereof and protrudes forward from the rotary cam 60. The engaging pin 62 is disposed at a prescribed angular position along the circumference of the rotary cam 60. A cam groove 63 is formed at a prescribed angular position in the same front side of the rotary cam 60. The cam groove 63 has an arc-shaped portion 63*a* formed in an arc shape that follows the outer circumference of the rotary cam 60 and has a prescribed central angle, and a radial portion 63*b* extending in a substantial radial direction of the rotary cam 60 from one end of the arc-shaped portion 63*a* toward the drive hole 61. The rotary cam 60 has a prescribed thickness dimension in its axial direction, i.e., in the front-rear direction. The outer circumferential surface of the rotary cam 60 encircling the axis of the same has a rear half forming a peripheral cam 64 and a front half forming a peripheral cam 65. The peripheral cams 64 and 65 have different circumferential contour shapes. The first detection sensor SW1 contacts the rear peripheral cam 64, and the second detection sensor SW2 contacts the front peripheral cam 65. The first detection sensor SW1 is an example of the claimed "second detector". The second detection sensor SW2 is an example of the claimed "first detector". The peripheral cam 64 is an example of the claimed "second portion". The peripheral cam 65 is an example of the claimed "first portion".

The rotary cam 60 is driven to rotate by a rotational drive force transmitted from the cutter motor 90 to the drive hole 61 via the gear mechanism 35 as illustrated in FIG. 25. When rotated, the rotary cam 60 can drive the full cutter 40 (specifically, the movable blade 43 described later) via the engaging pin 62 and can drive the half cutter 50 (specifically, the movable blade 53 described later) via the cam groove 63. The rotated position (i.e., the angular position) of the rotary cam 60 and the overall operating state of the cutting mechanism 30 can be determined based on detection results from the detection sensors SW1 and SW2.

Figure 4:
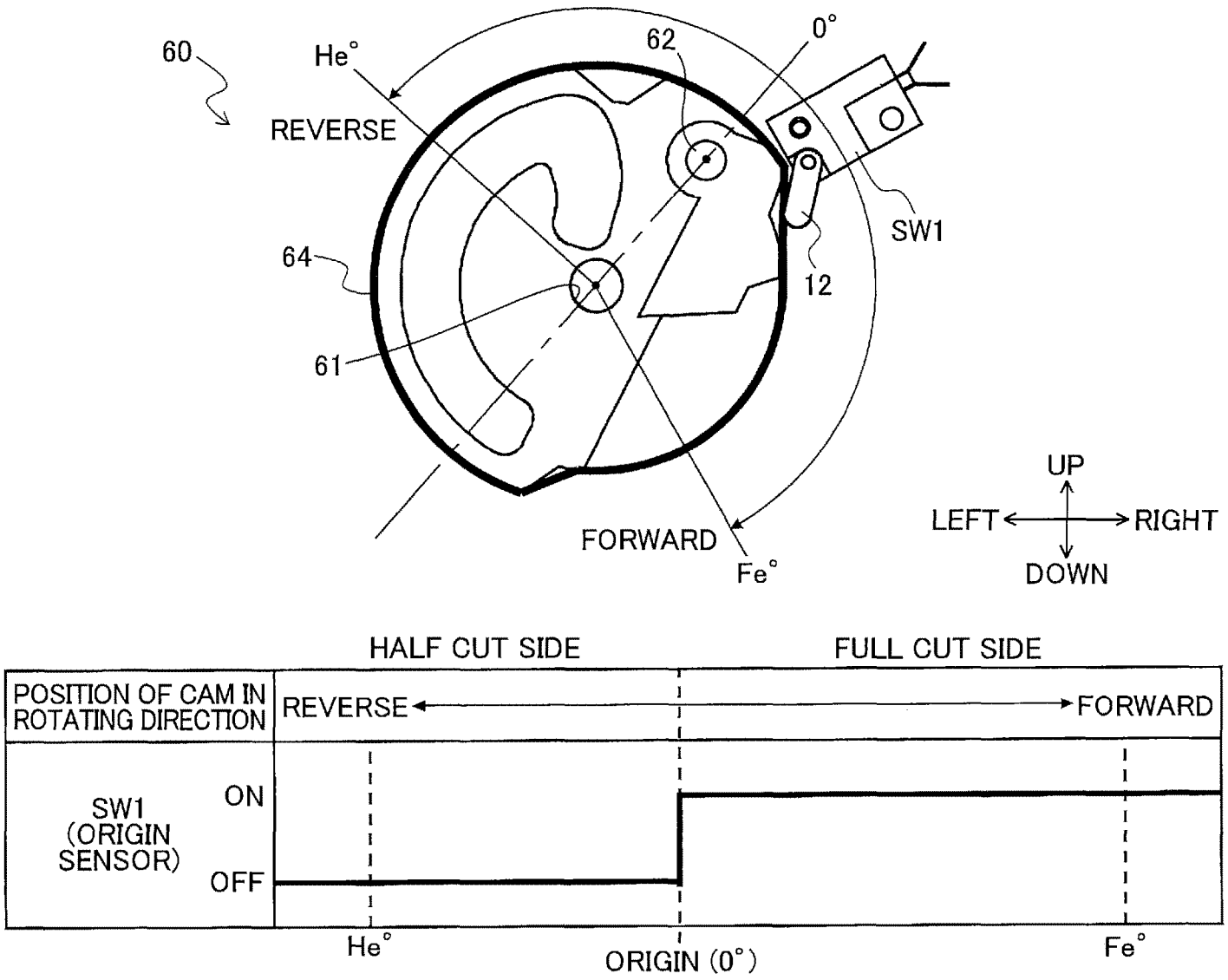
FIG. 4 is a view illustrating the contour shape of a rear-side peripheral cam of the rotary cam and also illustrating change in polarity of the detection signal from a first detection sensor of the printing device.

In the rotary cam 60 illustrated in FIG. 4, the thick line represents the contour shape of the rear-side peripheral cam 64 that is contacted by the first detection sensor SW1. In the rotary cam 60 illustrated in FIG. 5, the thick line represents the contour shape of the front-side peripheral cam 65 that is contacted by the second detection sensor SW2. Each of the detection sensors SW1 and SW2 has a contact 12 that is pivotably movable. Each contact 12 is urged in a direction toward the interior of the rotary cam 60 and is configured to contact the large diameter portion of the corresponding one of the peripheral cams 64 and 65. When contacting the outer diameter portion of the peripheral cam 64 or 65, the corresponding contact 12 is pushed outward and outputs an ON polarity (an ON signal). At all other times, the contact 12 separates from the corresponding peripheral cam 64 or 65, returns inward, and outputs an OFF polarity (an OFF signal). The ON polarity is an example of the claimed "first polarity". The OFF polarity is an example of the claimed "second polarity".

In the following description, the clockwise direction in the drawings will be called the forward direction of the rotary cam 60 and the counterclockwise direction will be called the reverse direction. In both FIGS. 4 and 5, the rotary cam 60 is oriented in a reference rotated position. Hereinafter, the reference rotated position will be also referred to as the origin position or 0°. The forward direction is an example of the claimed "first rotating direction". The reverse direction is an example of the claimed "second rotating direction". The reference rotated position (i.e., the origin position) is an example of the claimed "predetermined reference rotated position".

The bottom part of FIG. 4 indicates the detection output (the detection signal) from the first detection sensor SW1 configured to contact the rear peripheral cam 64 within the rotatable range of the rotary cam 60 from a forward limit position to a reverse limit position. As illustrated in the graph, the first detection sensor SW1 outputs the OFF signal throughout the entire reverse-rotation side of the origin position and outputs the ON signal throughout the entire forward-rotation side. Since this detection pattern of the first detection sensor SW1 can be used in a positioning process for positioning the rotary cam 60 at the origin position (i.e., the reference rotated position), as will be described later, the first detection sensor SW1 can be used as an origin sensor. Strictly speaking, the first detection sensor SW1 outputs the OFF signal at the origin position of the rotary cam 60 and outputs the ON signal immediately after the rotary cam 60 rotates slightly forward from the origin position, as will be described later.

Figure 5:
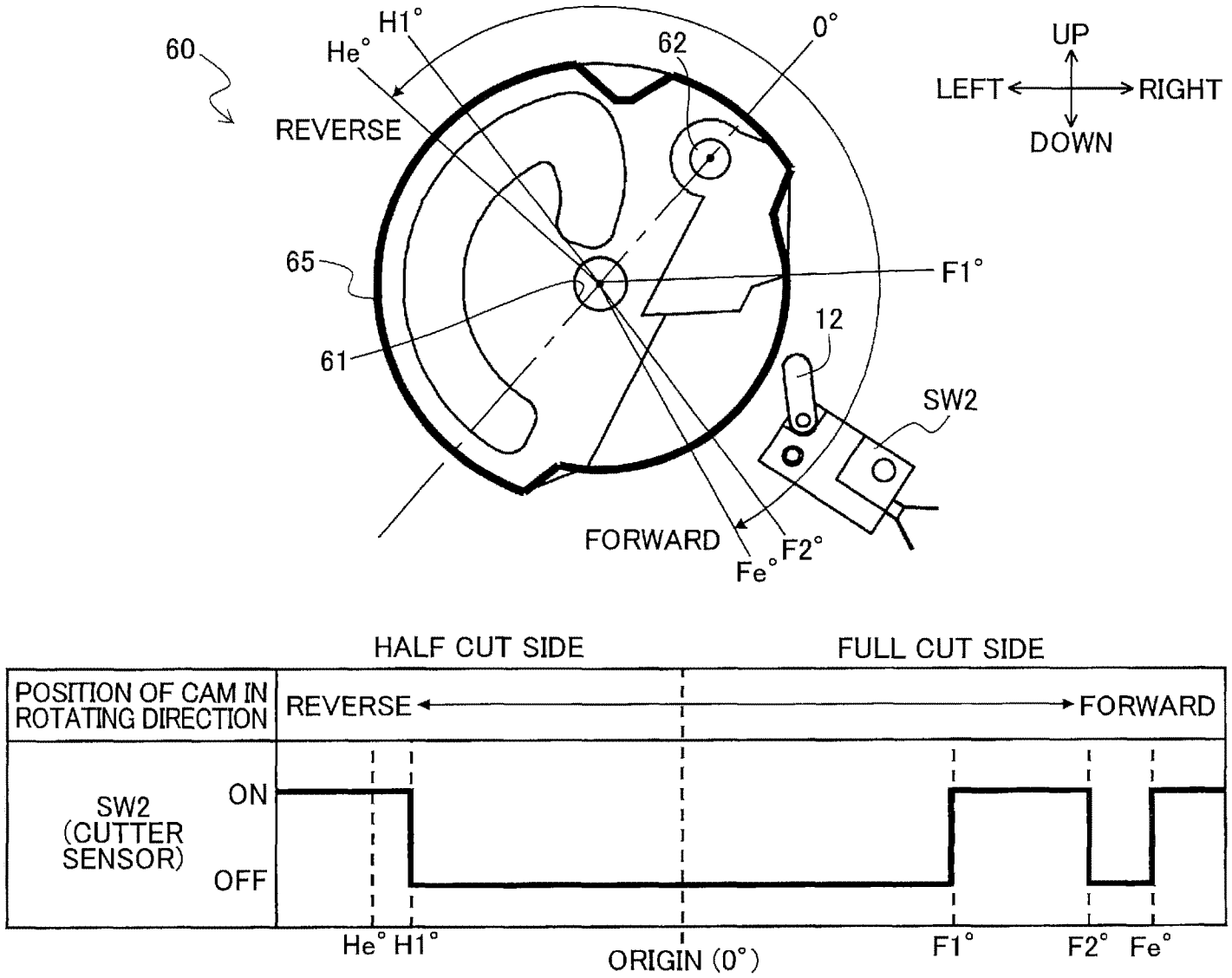
FIG. 5 is a view illustrating the contour shape of a front-side peripheral cam of the rotary cam and also illustrating change in polarity of the detection signal from a second detection sensor of the printing device.
Figure 6:
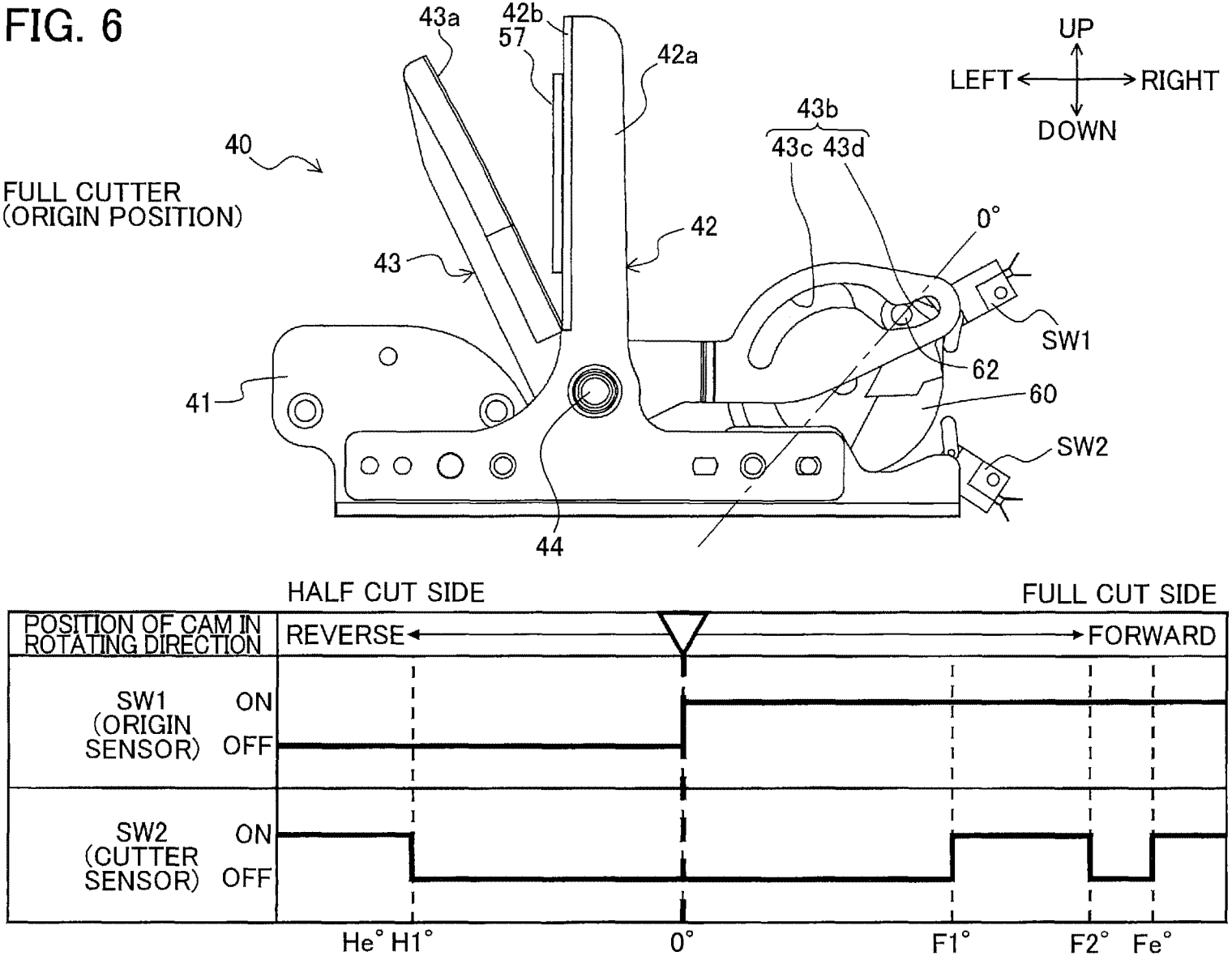
FIG. 6 is a view illustrating the operating state of a full cutter of the cutter mechanism in a state where the rotary cam is in the origin position.

The bottom part of FIG. 5 indicates the detection output (the detection signal) of the second detection sensor SW2 configured to contact the front peripheral cam 65 in the rotatable range of the rotary cam 60. As illustrated in the graph, the second detection sensor SW2 outputs the OFF signal as the rotary cam 60 moves within a range from the origin position to H1° in the reverse direction and outputs the ON signal when the rotary cam 60 is on the reverse-rotation side of H1°. The second detection sensor SW2 also outputs the OFF signal as the rotary cam 60 moves within a range from the origin position to F1° in the forward direction, outputs the ON signal when the rotary cam 60 is within a range extending to F2° on the forward-rotation side of F1°, outputs the OFF signal when the rotary cam 60 is within a range extending to Fe° on the forward-rotation side of F2°, and outputs the ON signal when the rotary cam 60 is on the forward-rotation side of Fe°. Thus, the detection pattern of the second detection sensor SW2 for both rotating directions indicates when the rotary cam 60 is at one of the rotated positions H1°, He° (described later), F1°, F2°, and Fe°. Each of these rotated positions corresponds to a position at which the operating state of one of the full cutter 40 and half cutter 50 changes, as will be described later. Accordingly, the second detection sensor SW2 can be used as a cutter sensor (a progress sensor) for detecting in particular the operating states (i.e., cutting progress) of the full cutter 40 and half cutter 50.

FIGS. 6 through 10 show each operating state of the full cutter 40 as the rotary cam 60 is rotated sequentially in the forward direction from the origin position. Note that the half cutter 50 has been omitted from the cutting mechanism 30 in these drawings. As illustrated in FIGS. 6 through 10, the full cutter 40 has a base 41, a fixed blade 42 that is fixed to the base 41, and the movable blade 43 that is supported so as to be pivotably movable relative to the fixed blade 42. The fixed blade 42 also has an extension part 42*a* extending upward, and a straight cutting edge 42*b* provided along the left edge of the extension part 42*a*. The movable blade 43 is formed in a general L-shape. The corner portion of the L-shaped movable blade 43 is pivotably supported by the fixed blade 42 via a rotational shaft 44. On the left-side arm portion of the L-shaped movable blade 43, a full-cutting edge 43*a* is provided along the edge facing the fixed blade 42. On the right-side arm portion of the movable blade 43, a cam hole 43*b* is formed in a region overlapping the rotary cam 60. The cam hole 43*b* engages with the engaging pin 62. The cam hole 43*b* has an arc portion 43*c* formed in an arc shape relative to the central axis of the rotary cam 60, and a radial portion 43*d* extending substantially in a radial direction of the rotary cam 60. The movable blade 43 (a full-cutting edge 43*a*) is an example of the claimed "full-cut blade" and also is an example of the claimed "first movable blade".

As illustrated in the drawings, the printed tape 57 waits in a state where its surface on the release paper side is in contact with the straight cutting edge 42*b* of the fixed blade 42. In a state where the rotary cam 60 is in the origin position illustrated in FIG. 6, the engaging pin 62 positions the movable blade 43 via the cam hole 43*b* to a pivotal position sufficiently far from the fixed blade 42 and printed tape 57, as illustrated in the drawing. By rotating the rotary cam 60 in the forward direction from this origin position, the engaging pin 62 pivotally moves the full-cutting edge 43*a* via the radial portion 43*d* of the cam hole 43*b* in a direction approaching the fixed blade 42, as illustrated by the sequence of FIGS. 7, 8, 9, and 10, whereby the full-cutting edge 43*a* fully cuts the printed tape 57 in the thickness direction.

Figure 7:
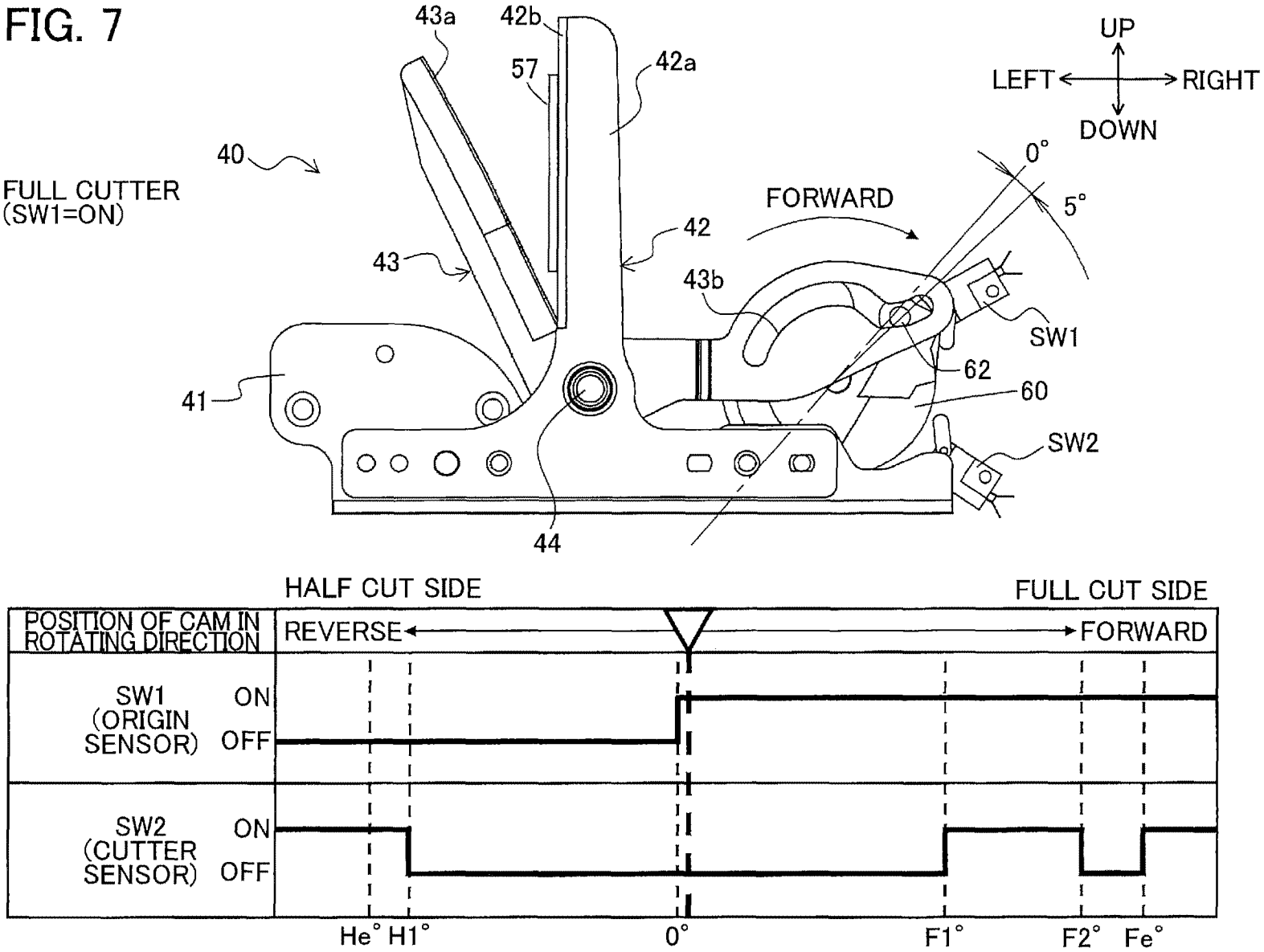
FIG. 7 is a view illustrating the operating state of the full cutter after the rotary cam is rotated slightly forward from the origin position.
Figure 8:
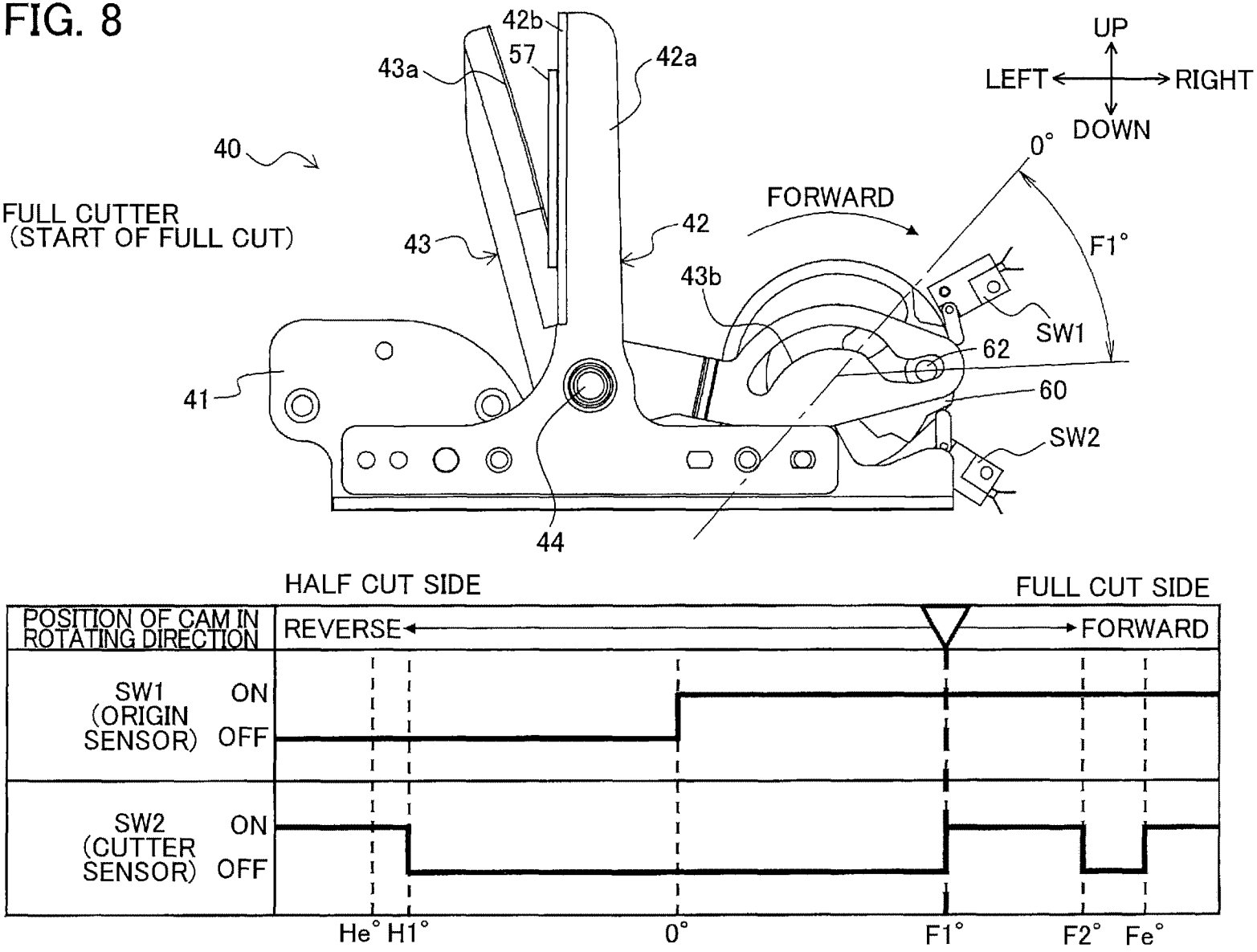
FIG. 8 is a view illustrating the operating state of the full cutter at the time of starting a full cut.
Figure 9:
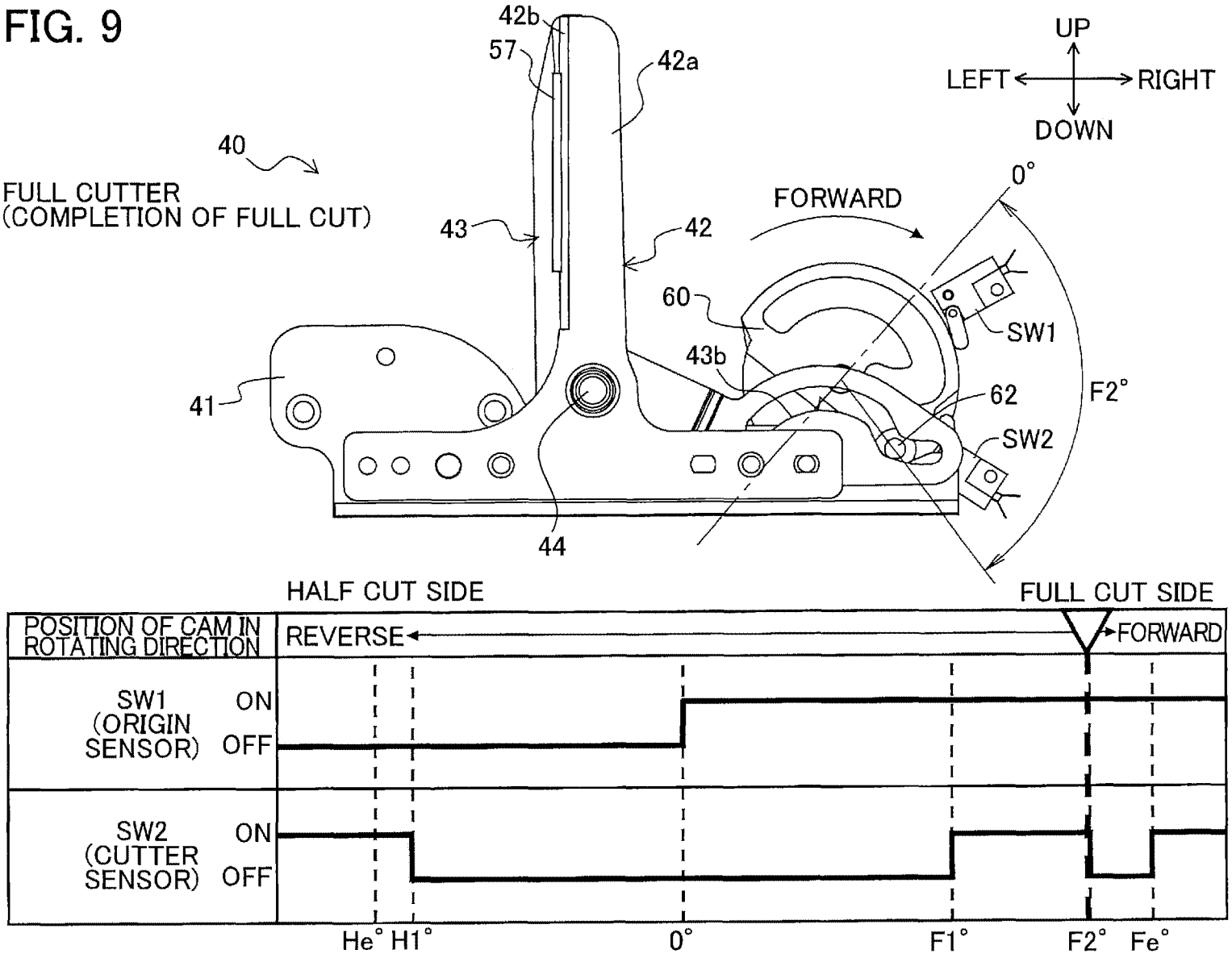
FIG. 9 is a view illustrating the operating state of the full cutter at the time of completing the full cut.
Figure 10:
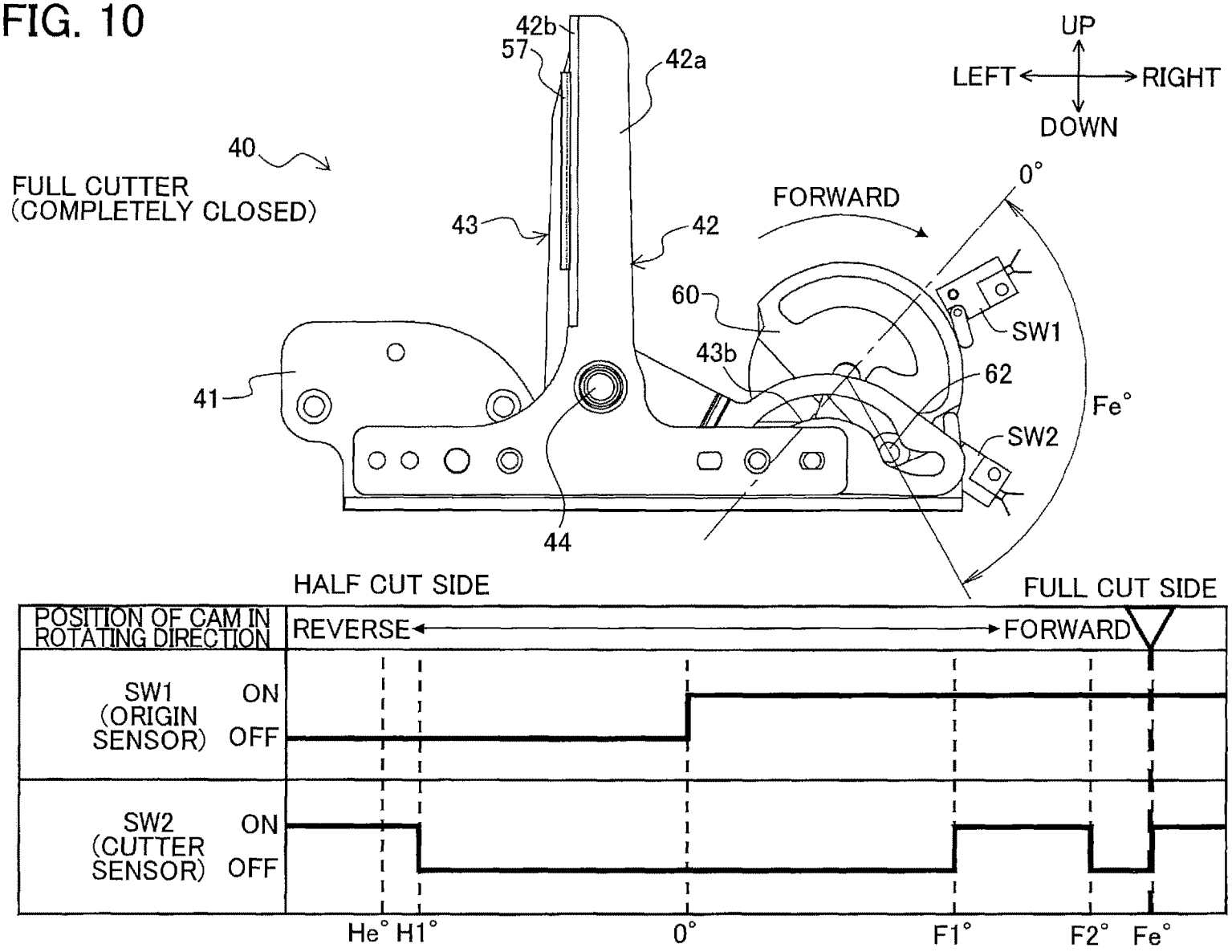
FIG. 10 is a view illustrating the operating state of the full cutter in a state where the full cutter is completely closed.

More specifically, when the rotary cam 60 is rotated even slightly forward from the origin position, as illustrated in FIG. 7, the detection signal from the first detection sensor SW1 switches from the OFF signal to the ON signal. When the rotary cam 60 is further rotated to F1°, as illustrated in FIG. 8, the full-cutting edge 43*a* of the movable blade 43 contacts and begins to cut the printed tape 57. At this time, the detection signal from the second detection sensor SW2 switches from the OFF signal to the ON signal. When the rotary cam 60 is further rotated forward to F2°, as illustrated in FIG. 9, the full cut of the printed tape 57 is completed and the detection signal from the second detection sensor SW2 switches from the ON signal to the OFF signal. When the rotary cam 60 is rotated further forward to Fe°, as illustrated in FIG. 10, the fixed blade 42 and movable blade 43 reach a completely closed state and the detection signal from the second detection sensor SW2 switches from the OFF signal to the ON signal. The F1° position is an example of the claimed "first specific rotated position". The time period required for the rotary cam 60 to rotate from the origin position to the F1° position is an example of the claimed "first prescribed period of time".

In the above process, the full cutter 40 completely cuts through the entire printed tape 57 in the thickness direction and can completely separate the printed portion of the tape 57 from the remaining portion thereof in the longitudinal direction. While not illustrated in the drawings, the rotary cam 60 moves only within the arc portion 43*c* of the cam hole 43*b* when the rotary cam 60 is rotated in the reverse direction from the origin position so that the movable blade 43 does not pivot at all. Hence, the full cutter 40 is driven only when the rotary cam 60 rotates on the forward-rotation side of the origin position.

Figure 11:
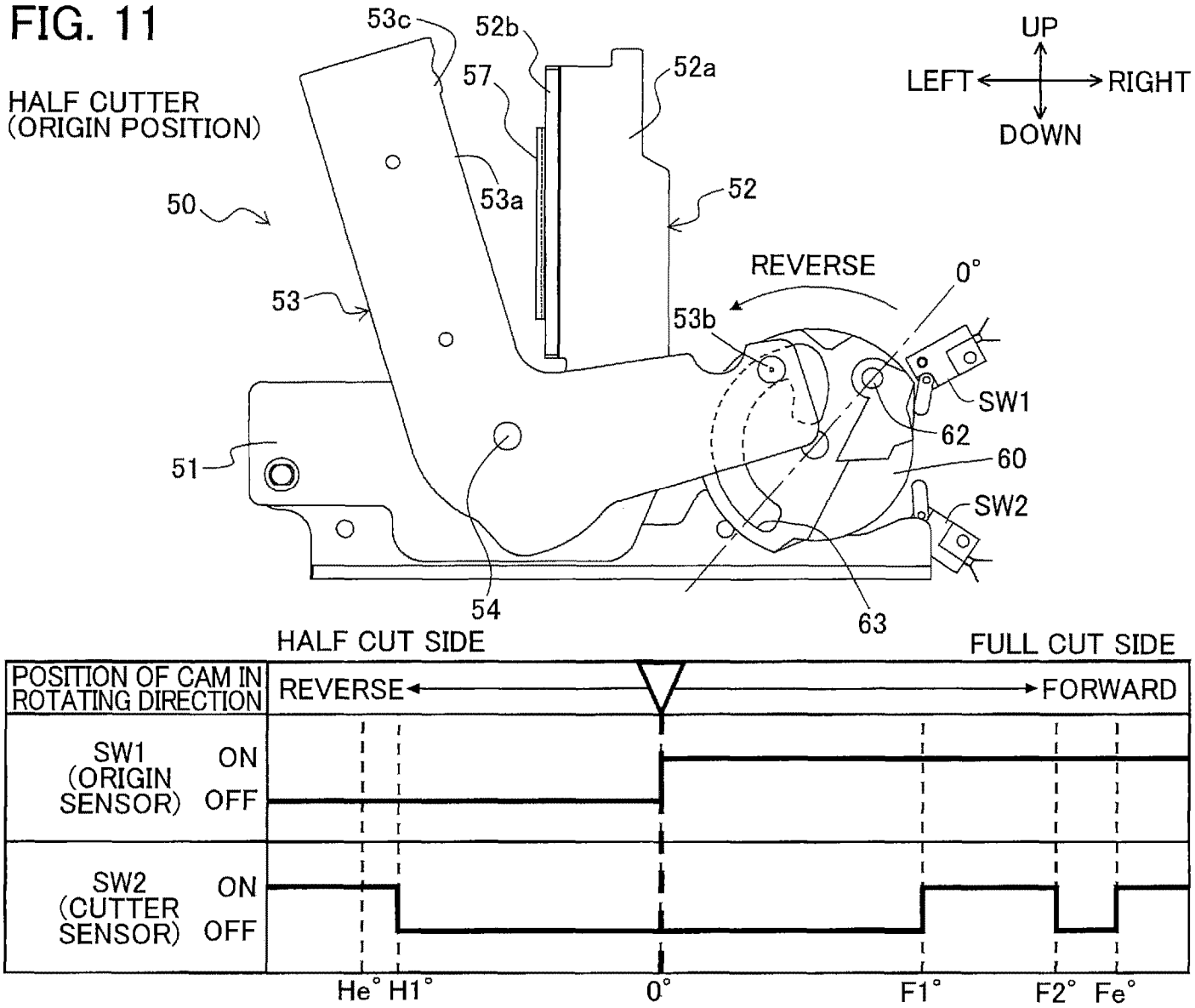
FIG. 11 is a view illustrating the operating state of a half cutter of the cutter mechanism in a state where the rotary cam is in the origin position.
Figure 12:
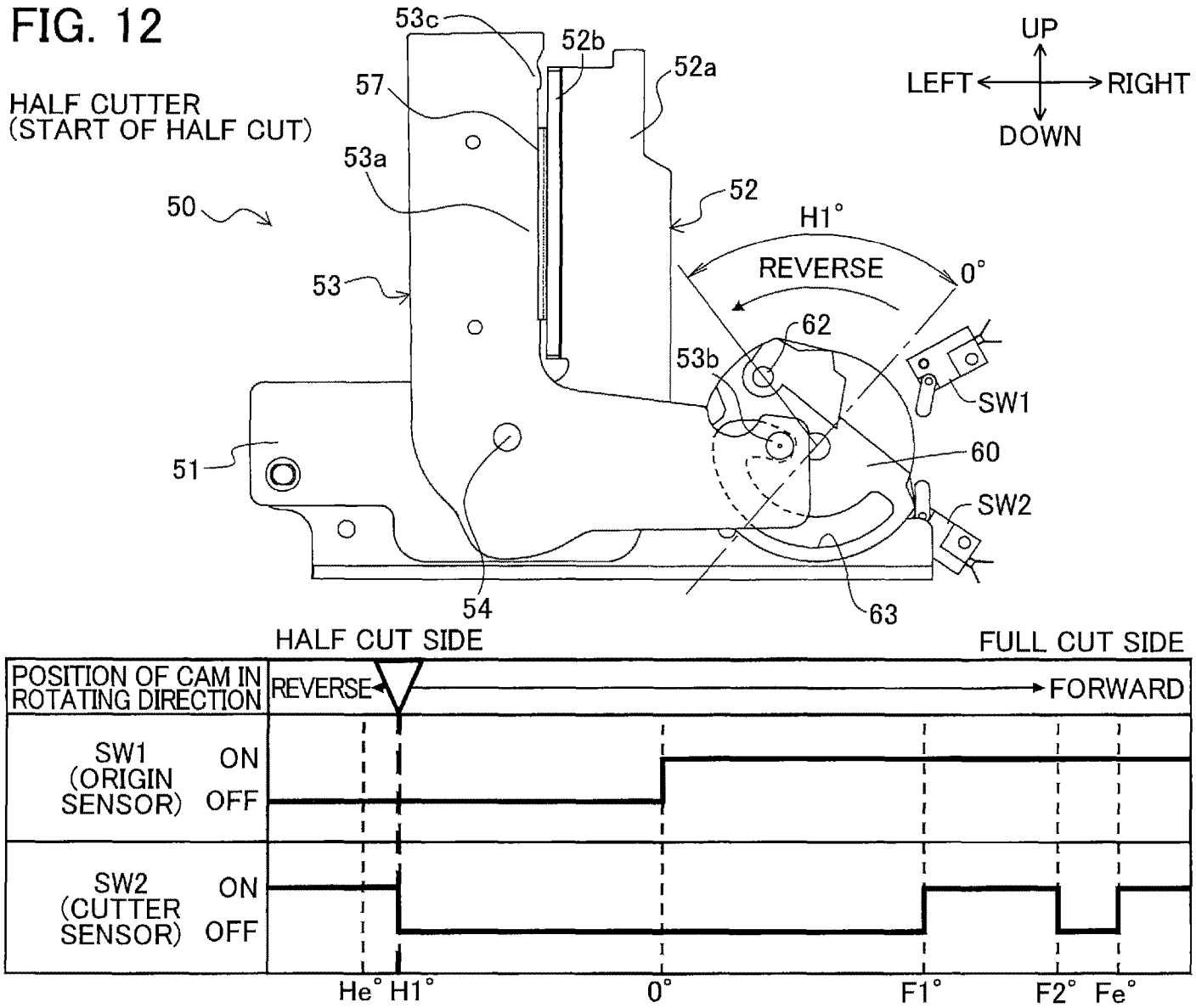
FIG. 12 is a view illustrating the operating state of the half cutter at the time of starting a half cut.
Figure 13:
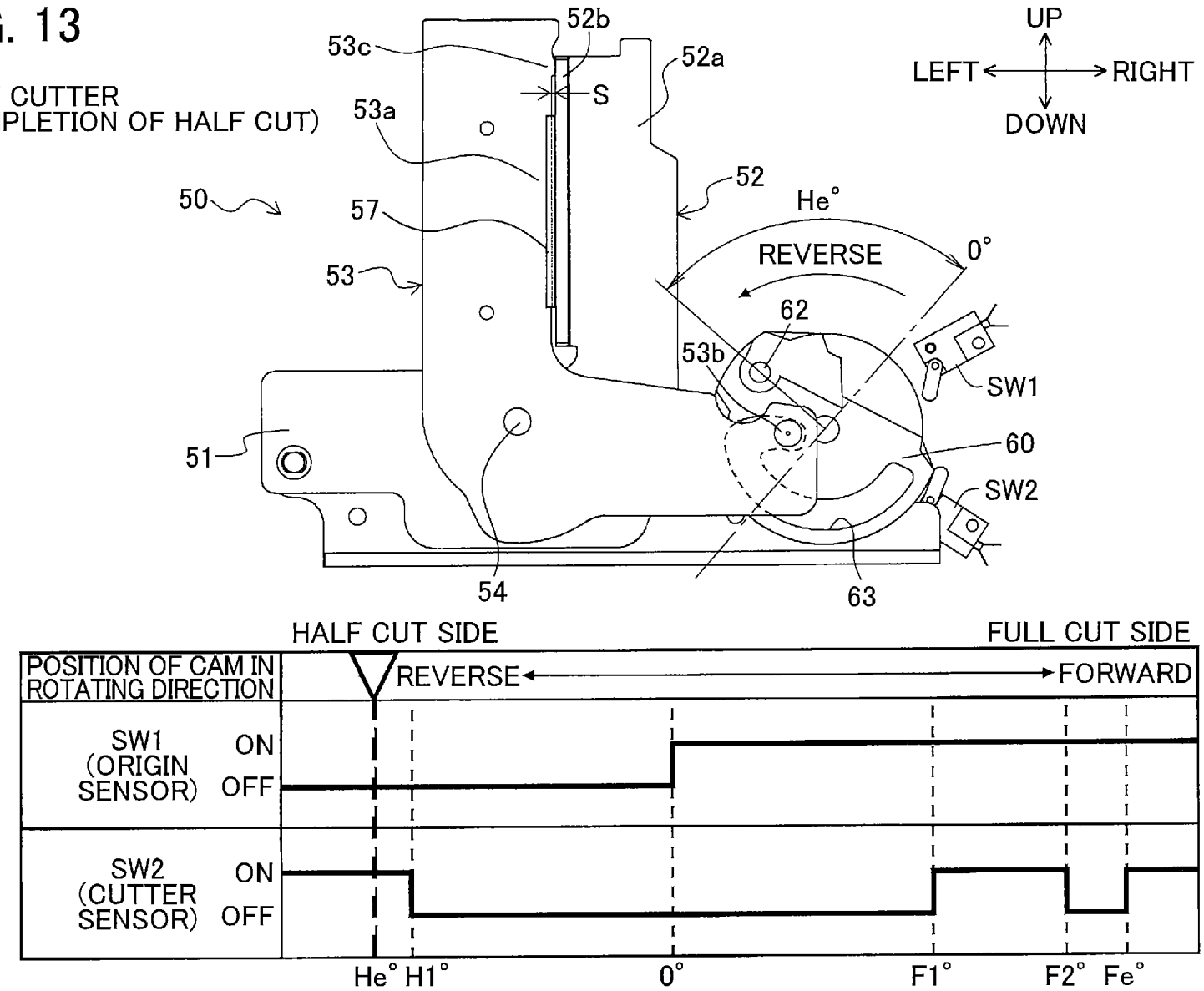
FIG. 13 is a view illustrating the operating state of the half cutter at the time of completing the half cut.

FIGS. 11 through 13 show each operating state of the half cutter 50 as the rotary cam 60 is rotated sequentially in the reverse direction from the origin position. Note that the full cutter 40 of the cutting mechanism 30 has been omitted in these drawings. As illustrated in FIGS. 11 through 13, the half cutter 50 has a base 51, a fixed blade 52 that is fixed to the base 51, and the movable blade 53 that is supported so as to be pivotally movable relative to the fixed blade 52. The fixed blade 52 also has an extension part 52*a* that extends upward, and a straight cutting edge 52*b* provided along the left edge of the extension part 52*a*. The movable blade 53 is formed in a general L-shape. The corner portion of the L-shaped movable blade 53 is pivotably supported by the fixed blade 52 through a rotational shaft 54. On the left-side arm portion of the L-shaped movable blade 53, a half-cutting edge 53*a* is provided along the edge facing the fixed blade 52. On the right-side arm portion of the movable blade 53, an engaging pin 53*b* is provided in a region overlapping the rotary cam 60. The engaging pin 53*b* protrudes rearward so as to engage in the cam groove 63 of the rotary cam 60. The movable blade 53 (a half-cutting edge 53*a*) is an example of the claimed "half-cut blade" and also is an example of the claimed "second movable blade".

As illustrated in the drawings, the printed tape 57 waits in a state where its surface on the release paper side is in contact with the straight cutting edge 52*b* of the fixed blade 52. In FIG. 11, the rotary cam 60 is in the origin position and the cam groove 63 positions the movable blade 53 via the engaging pin 53*b* to a position rotated sufficiently far from the fixed blade 52 and printed tape 57, as illustrated in the drawing. When the rotary cam 60 is rotated in the reverse direction from this origin position, the radial portion 63*b* of the cam groove 63 pivotally moves the movable blade 53 via the engaging pin 53*b* in a direction approaching the fixed blade 52, as illustrated sequentially in FIGS. 12 and 13, so that the movable blade 53 performs a half cut, i.e., a partial cut through the printed tape 57 in the thickness direction.

Specifically, when the rotary cam 60 is rotated to H1°, as illustrated in FIG. 12, the half-cutting edge 53*a* of the movable blade 53 contacts and begins cutting the printed tape 57. At this time, the detection signal from the second detection sensor SW2 switches from the OFF signal to the ON signal. When the rotary cam 60 is further rotated in reverse to He°, as illustrated in FIG. 13, the movable blade 53 completes the half cut in the printed tape 57 while the detection signal from the second detection sensor SW2 remains the ON signal. At this time, a protruding part 53*c* provided at the distal end of the movable blade 53 contacts the edge of the fixed blade 52. At this time, the half-cutting edge 53*a* is positioned parallel to the straight cutting edge 52*b* of the fixed blade 52 but is separated from the straight cutting edge 52*b* by a gap S. Since the gap S is equivalent to the thickness dimension of the release paper in the tape 57, the half cutter 50 can perform a half cut that cuts through all layers of the tape 57 excluding the release paper. The H1° position is an example of the claimed "second specific rotated position". The time period for the rotary cam 60 to rotate from the origin position to the H1° position is an example of the claimed "second prescribed period of time".

Through the above process, the half cutter 50 performs a half cut by cutting through all layers of the tape 57 excluding the release paper, thereby leaving the release paper intact in the longitudinal direction of the tape. While not specifically illustrated in the drawings, when the rotary cam 60 is rotated in the forward direction from the origin position, the movable blade 53 does not pivot at all since the engaging pin 53*b* of the movable blade 53 moves only within the arc-shaped portion 63*a* of the cam groove 63. Hence, the half cutter 50 is driven only when the rotary cam 60 rotates on the reverse-rotation side of the origin position.

<Control Structure of the Printing Device>

Figure 14:
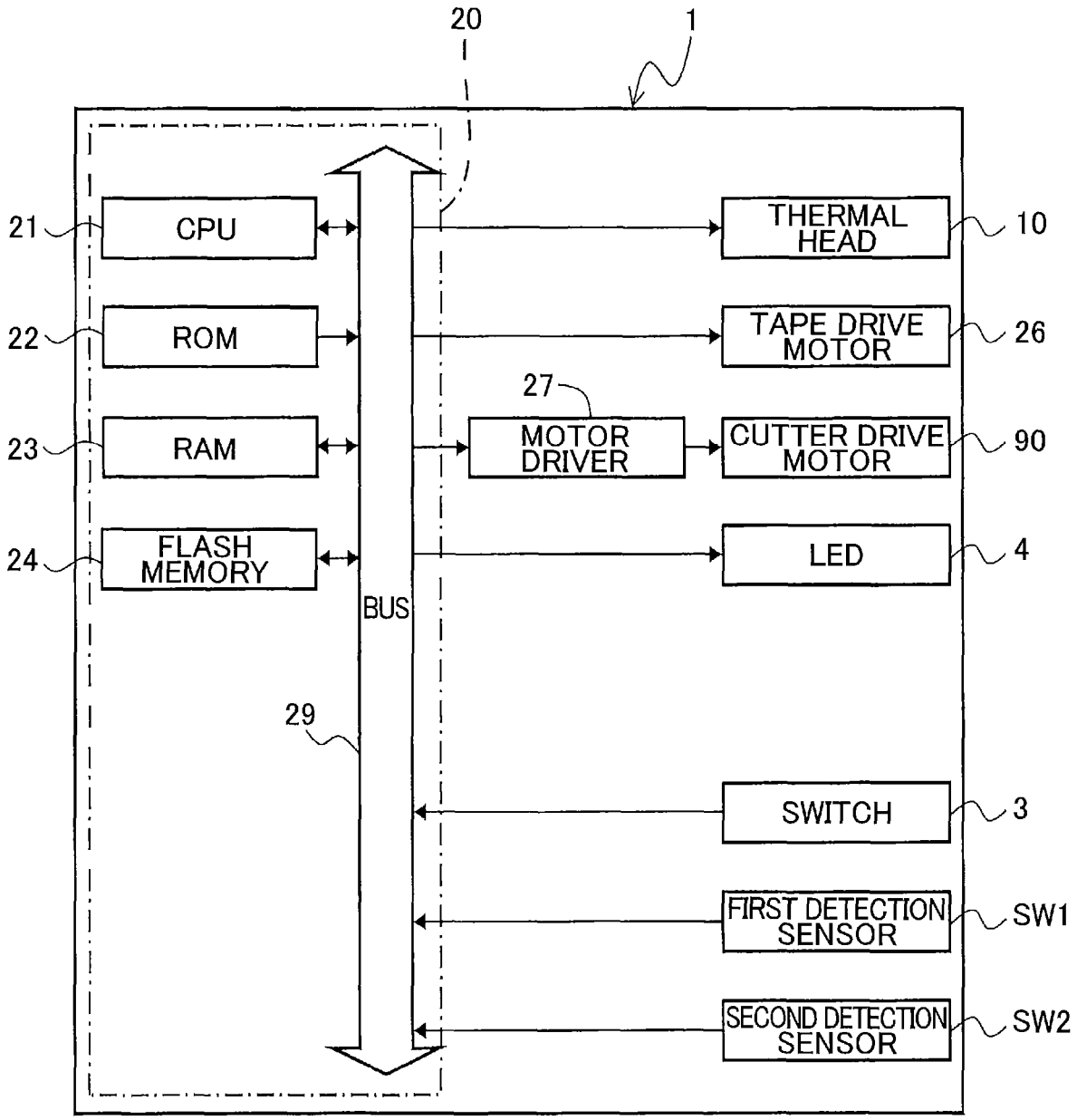
FIG. 14 is a block diagram illustrating the control structure of the printing device.

As illustrated in FIG. 14, the printing device 1 is provided with a controller 20. The controller 20 includes a CPU 21, a ROM 22, a RAM 23, a flash memory 24, and the like, which are connected to one another via a bus 29. The CPU 21 performs overall control of the printing device 1. The ROM 22 stores various parameters that the CPU 21 requires when executing various programs. The RAM 23 temporarily stores data, such as timers and counters. The flash memory 24 stores a program and the like required for the CPU 21 to implement an origin detection process described later.

The CPU 21 is connected to the switches 3, first detection sensor SW1, and second detection sensor SW2 via the bus 29. The switches 3, first detection sensor SW1, and second detection sensor SW2 input into the CPU 21 information (such as signals and the like) required for control.

The CPU 21 is also connected to the thermal head 10, tape drive motor 26, a motor driver 27, and the LEDs 4 via the bus 29. The CPU 21 outputs commands or signals required for controlling the thermal head 10, tape drive motor 26, motor driver 27, and LEDs 4.

The motor driver 27 is a driver element for driving the cutter motor 90 in response to commands outputted from the CPU 21. The CPU 21 sequentially outputs commands for forward rotation, reverse rotation, and stopping to the motor driver 27 in a prescribed system cycle that is sufficiently short, and the motor driver 27 controls the drive of the cutter motor 90 based on the inputted commands. For example, while the CPU 21 continuously outputs a command for forward rotation or reverse rotation, the motor driver 27 can rotate the cutter motor 90 in the specified direction at a constant speed, and the amount that the cutter motor 90 is rotated can be controlled by the length of time the command is continuously outputted. In actuality, in halting the cutter motor 90, a short braking time is required for the cutter motor 90 to comes to a complete stop from the moment the stop command is inputted. However, by storing the relationships between various control times (such as the above-mentioned braking time and the like) and rotation amounts as known parameters and incorporating these parameters in control, the CPU 21 can precisely control the positioning of the rotary cam 60.

Further, since detection results (i.e., the detection signal) from the detection sensors SW1 and SW2 are inputted sequentially into the CPU 21 at the sufficiently short prescribed system cycle, the CPU 21 can detect changes in the rotated position of the rotary cam 60 in real-time.

<Various Control Sequences>

As described above, the CPU 21 can detect the operating state of the cutting mechanism 30 at the current time based on detection results from the detection sensors SW1 and SW2. As illustrated in FIGS. 15 through 22, the entire rotatable range of the rotary cam 60 can be divided into six regions A-F, for example. That is, region A extends from the reverse limit position of the rotary cam 60 to the H1° position, region B extends from the H1° position to the origin position, region C extends from the origin position to the F1° position, region D extends from the F1° position to the F2° position, region E extends from the F2° position to the Fe° position, and region F extends from the Fe° position to the forward limit position of the rotary cam 60. Note that the moving times required for the rotary cam 60 to move through each region as the rotary cam 60 rotates are pre-stored as known parameters.

With this arrangement, when the detection results (i.e., the detection signals) from the detection sensors SW1 and SW2 are the OFF signal and the ON signal, respectively, the CPU 21 can uniquely infer that the rotary cam 60 is positioned in region A at this time. When the detection results from the detection sensors SW1 and SW2 are both the OFF signals, the CPU 21 can uniquely infer that the rotary cam 60 is positioned in region B at this time. When the detection results from the detection sensors SW1 and SW2 are the ON signal and the OFF signal, respectively, the CPU 21 can infer that the rotary cam 60 is positioned either in region C or region E at this time. When the detection results from the detection sensors SW1 and SW2 are both the ON signals, the CPU 21 can infer that the rotary cam 60 is positioned in either region D or region F at this time. In this way, the CPU 21 can infer the approximate rotated position of the rotary cam 60 at any timing based on the combination of detection results from the two detection sensors SW1 and SW2. Hence, the CPU 21 can control the operating state of the cutting mechanism 30 to change the rotated position of the rotary cam 60 in a prescribed sequence.

If it is assumed that the rotary cam 60 is in the origin position initially, the CPU 21 performs a closing operation with respect to the full cutter 40 (i.e., a full cutting operation) by rotating the rotary cam 60 forward from the origin position and by halting forward rotation of the rotary cam 60 when the rotary cam 60 reaches the Fe° position (SW1=ON and SW2=ON). In this case, after the start of forward rotation, the rotary cam 60 passes through region C (SW1=ON and SW2=OFF), region D (SW1=ON and SW2=ON), and region E (SW1=ON and SW2=OFF) in this order, and then reaches the Fe° position (SW1=ON and SW2=ON), as illustrated in the upper part of FIG. 15. Subsequently, the CPU 21 can perform an opening operation for the full cutter 40 by rotating the rotary cam 60 in reverse from the Fe° position and by halting reverse rotation of the rotary cam 60 when the rotary cam 60 returns to the origin position. In this opening operation, in response to detecting that the detection signal from the detection sensor SW1 is switched from the ON signal to the OFF signal, the CPU 21 determines that the rotary cam 60 has returned to the origin position. Full-cut control can be implemented through the above control sequence.

Figure 15:
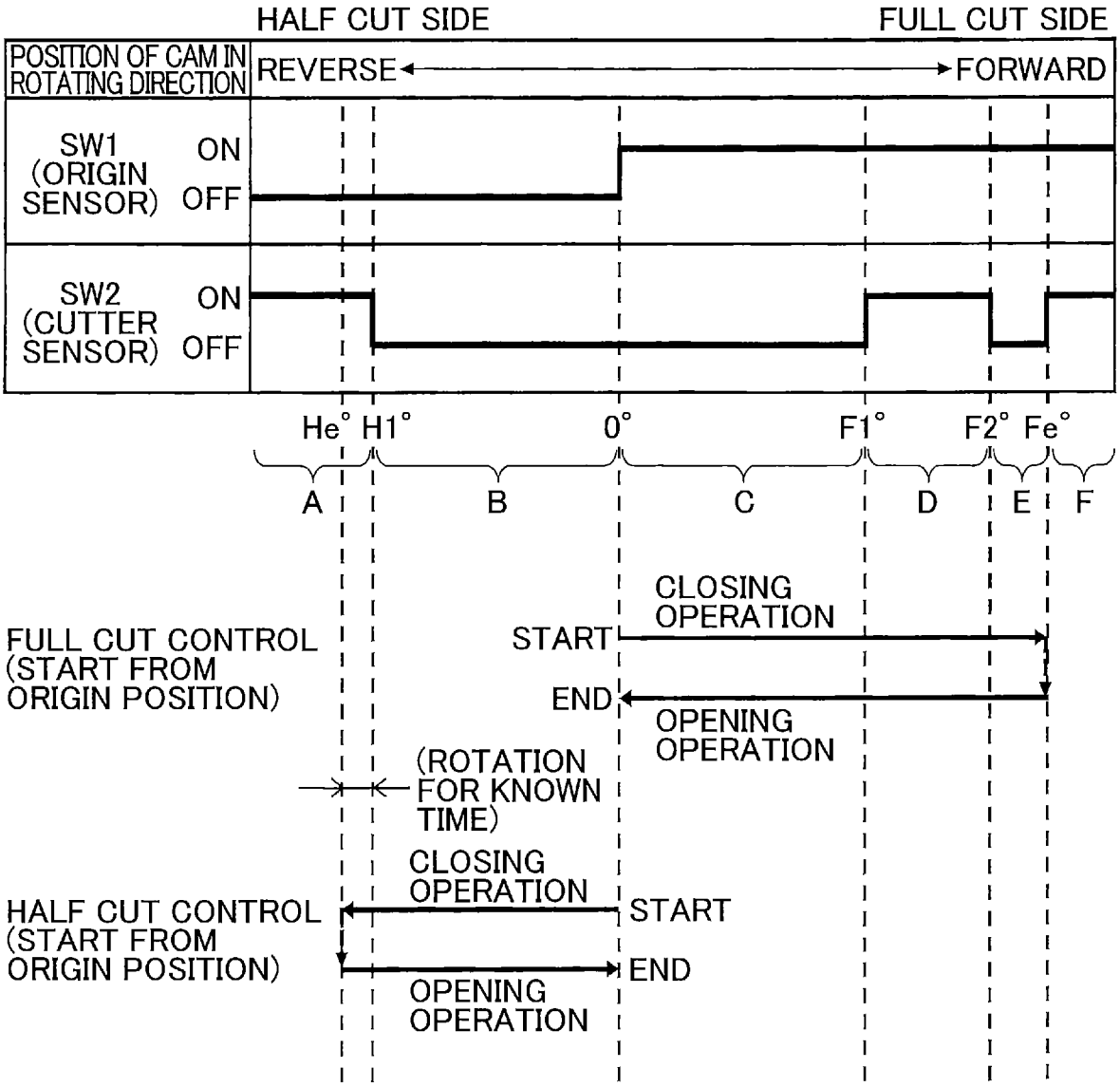
FIG. 15 is a view illustrating control sequences in a full cut control and a half cut control performed in the printing device.

Similarly, if it is assumed that the rotary cam 60 is in the origin position initially, the CPU 21 can perform a closing operation for the half cutter 50 (i.e., a half-cut operation) by rotating the rotary cam 60 in reverse from the origin position so that the rotary cam 60 passes through region B (SW1=OFF and SW2=OFF) and by halting reverse rotation when the rotary cam 60 reaches the He° position, as illustrated in the bottom part of FIG. 15. In this closing operation, in response to a known prescribed time having elapsed from the timing at which the CPU 21 detects that the detection signal from the detection sensor SW2 is switched from the OFF signal to the ON signal, the CPU 21 determines that the rotary cam 60 has reached the He° position. Subsequently, the CPU 21 can perform an opening operation for the half cutter 50 by rotating the rotary cam 60 forward from the He° position and by halting forward rotation when the rotary cam 60 has arrived at the origin position. In this opening operation, in response to detecting that the detection signal from the detection sensor SW1 is switched from the OFF signal to the ON signal, the CPU 21 determines that the rotary cam 60 has arrived at the origin position. Half-cut control can be implemented through the above control sequence.

The control sequences described above assume that the rotary cam 60 is initially in the origin position. However, the rotary cam 60 may not necessarily be in the origin position, such as when the power to the printing device 1 is turned on. Accordingly, when the rotary cam 60 may not be in the origin position such as when the printing device 1 is turned on or reset, the CPU 21 must execute an origin detection control sequence for placing the rotary cam 60 in the origin position.

Figure 16:
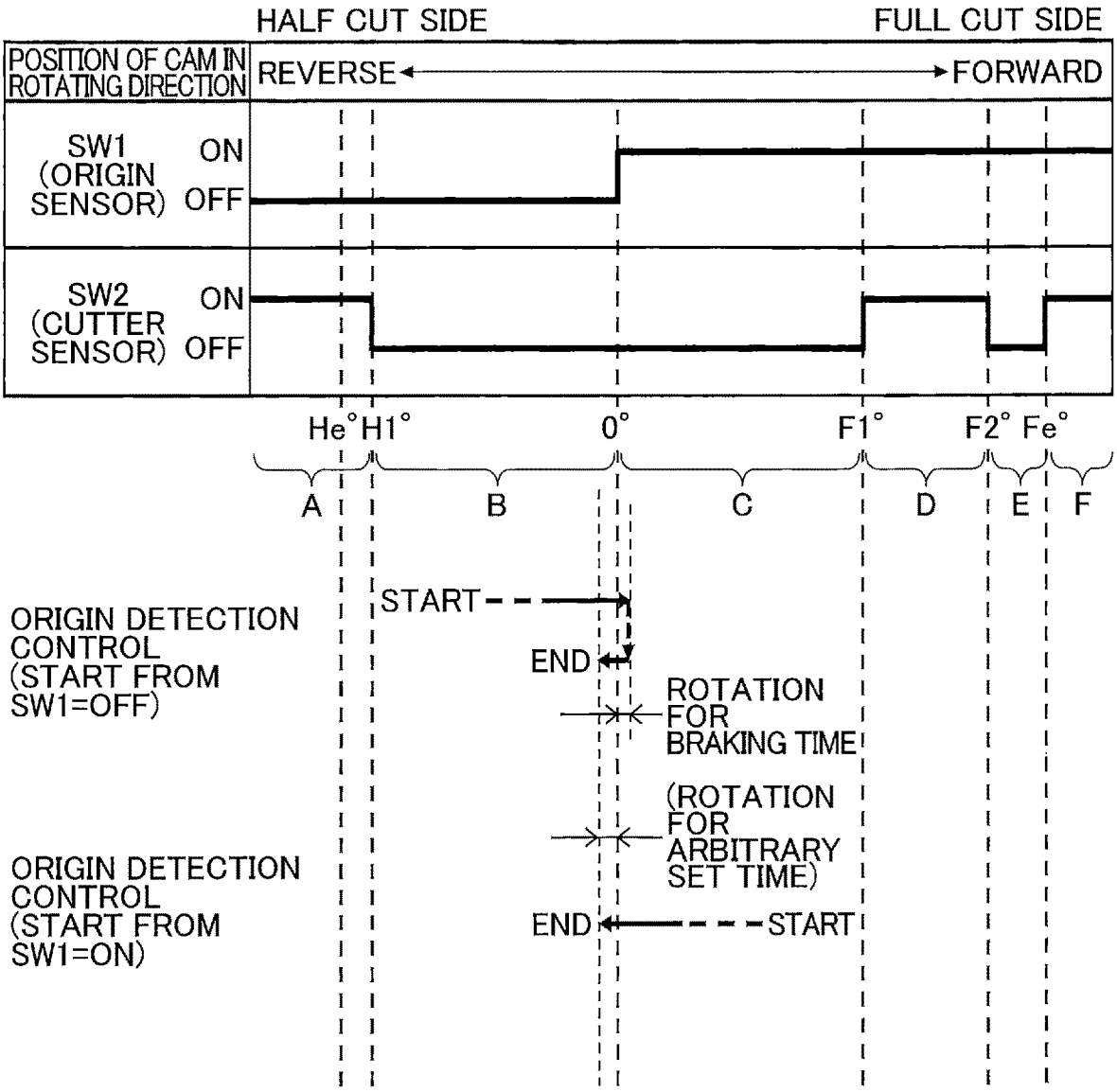
FIG. 16 is a view illustrating control a control sequence in origin position detection control in a case where both the first and second detection sensors are in their normal state.

For example, if the CPU 21 begins origin detection control in a state where the rotary cam 60 is initially positioned on the reverse-rotation side of the origin position, i.e., if the CPU 21 starts origin detection control from a state where the detection signal from the detection sensor SW1 is the OFF signal, as illustrated in the upper part of FIG. 16, the CPU 21 first rotates the rotary cam 60 forward. The CPU 21 halts the forward rotation when the rotary cam 62 reaches the origin position (i.e., the detection signal from the first detection sensor SW1 is switched to the ON signal). Subsequently, the CPU 21 rotates the rotary cam 60 in reverse. Then, the CPU 21 halts the reverse rotation when an arbitrary set time has elapsed from the timing at which the detection signal from the first detection sensor SW1 is switched to the OFF signal. That is, even after the rotary cam 60 has returned to the origin position from the forward-rotation side of the origin position, the CPU 21 continues the reverse rotation of the rotary cam 60 only for the arbitrary set time. Thereafter, the CPU 21 again rotates the rotary cam 60 forward by a rotation amount corresponding to the arbitrary set time at such a slow speed that enables the rotary cam 60 to come to a complete stop immediately after the input of a stop command. By this forward rotation, the rotary cam 60 is finally positioned at the precise origin position. Incidentally, the arbitrary set time and the rotation amount corresponding thereto are stored in the ROM 22 as known parameters.

If the CPU 21 starts origin detection control in a state where the rotary cam 60 is initially positioned on the forward-rotation side of the origin position, i.e., if the CPU 21 begins origin detection control from a state where the detection signal from the first detection sensor SW1 is the ON signal, as illustrated in the bottom part of FIG. 16, the CPU 21 first rotates the rotary cam 60 in reverse. After the rotary earn 60 reaches the origin position (i.e., the detection signal from the first detection sensor SW1 is switched to the OFF signal), the CPU 21 continues the reverse rotation of the rotary cam 60 for the arbitrary set time and then halts the reverse rotation. In other words, the CPU 21 halts the reverse rotation of the rotary cam 60 when the arbitrary set time has elapsed from the timing at which the detection signal from the first detection sensor SW1 is switched to the OFF signal. Thereafter, the CPU 21 again rotates the rotary cam 60 forward by the rotation amount corresponding to the arbitrary set time at such a slow speed that enables the rotary cam 60 to completely stop immediately after the input of a stop command. By this forward rotation, the rotary cam 60 is finally positioned at the precise origin position.

Through the control sequences described above, the CPU 21 can place the rotary cam 60 in the precise origin position described above, i.e., the rotated position at which the detection signal from the first detection sensor SW1 is switched from the OFF signal to the ON signal immediately after the start of forward rotation of the rotary cam 60. The arbitrary set time described above is preset to a sufficiently short amount of time in consideration of the above-mentioned braking time of the cutter motor 90, i.e., the time required for the cutter motor 90 to completely stop from the moment that the stop command is inputted.

<Origin Detection Control in the Event of Sensor Failure>

Figure 17:
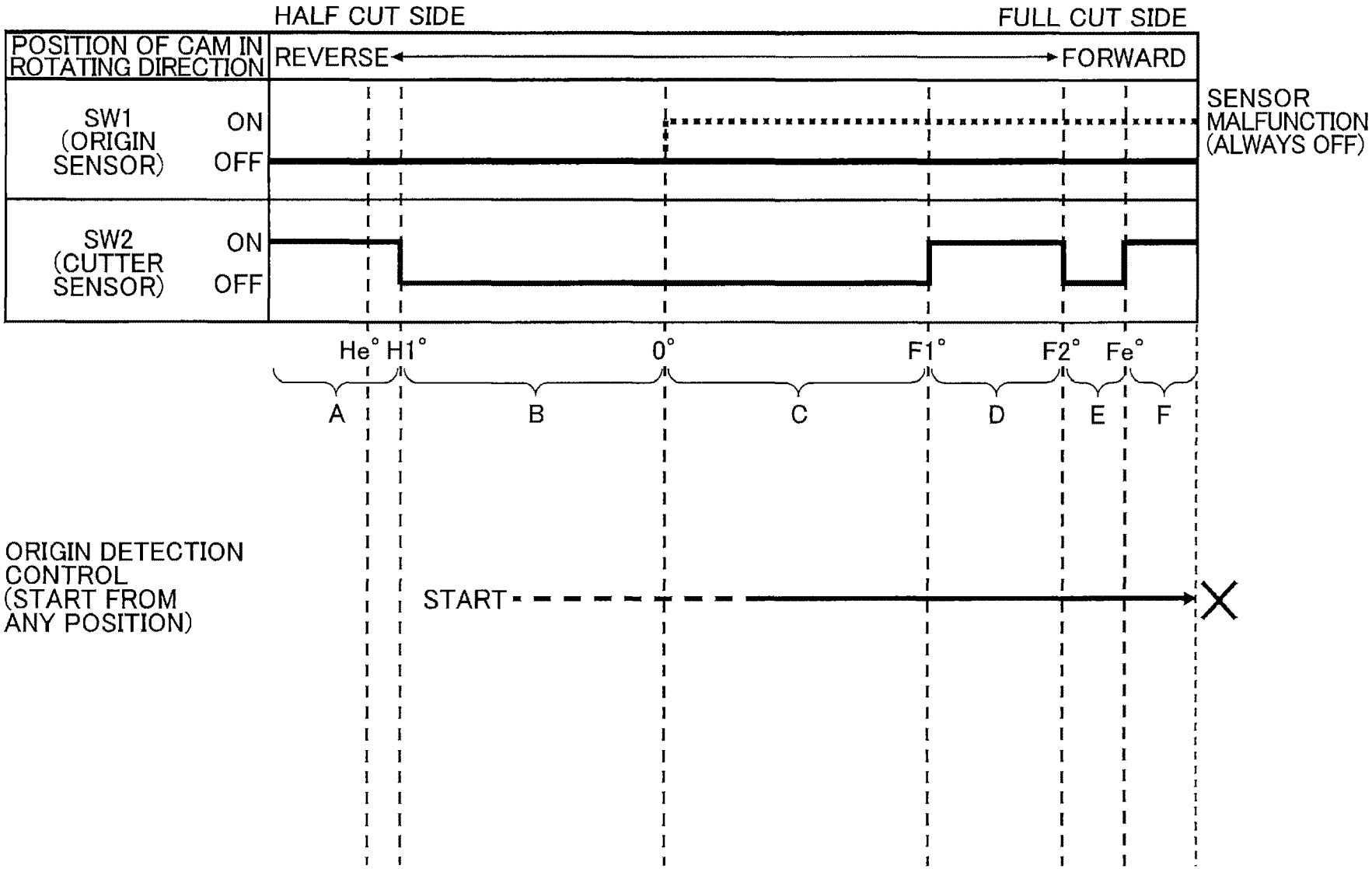
FIG. 17 is a view illustrating control a control sequence in origin detection control in case of malfunction of the first detection sensor under the assumption that the origin detection control is based only on the first detection sensor.

Detection sensors may malfunction for any of various reasons when executing positioning in the origin detection control as described above. The detection sensors SW1 and SW2 in the present embodiment are so-called normally-off sensors. Accordingly, when the detection sensors SW1 and SW2 malfunction, each of the detection signals therefrom does not switch to the ON signal, that is, the OFF signal is maintained regardless of the pivot angle of the contact 12. As illustrated in FIG. 17, in a state where the first detection sensor SW1 malfunctions, the detection result (the detection signal) from the first detection sensor SW1 is always the OFF signal no matter the rotated position of the rotary cam 60. Accordingly, if the CPU 21 started origin detection control based only on the detection signal from the first detection sensor SW1, the CPU 21 would initially rotate the rotary cam 60 forward and never detect that the detection signal from the first detection sensor SW1 is switched to the ON signal. Hence, the cutter motor 90 would continue applying a rotational drive force even after the rotary cam 60 has reached its advancing or retracting limit and the movable blade 43 of the full cutter 40 can move no further. This could adversely affect the durability of the gear mechanism 35 described above.

Figure 18:
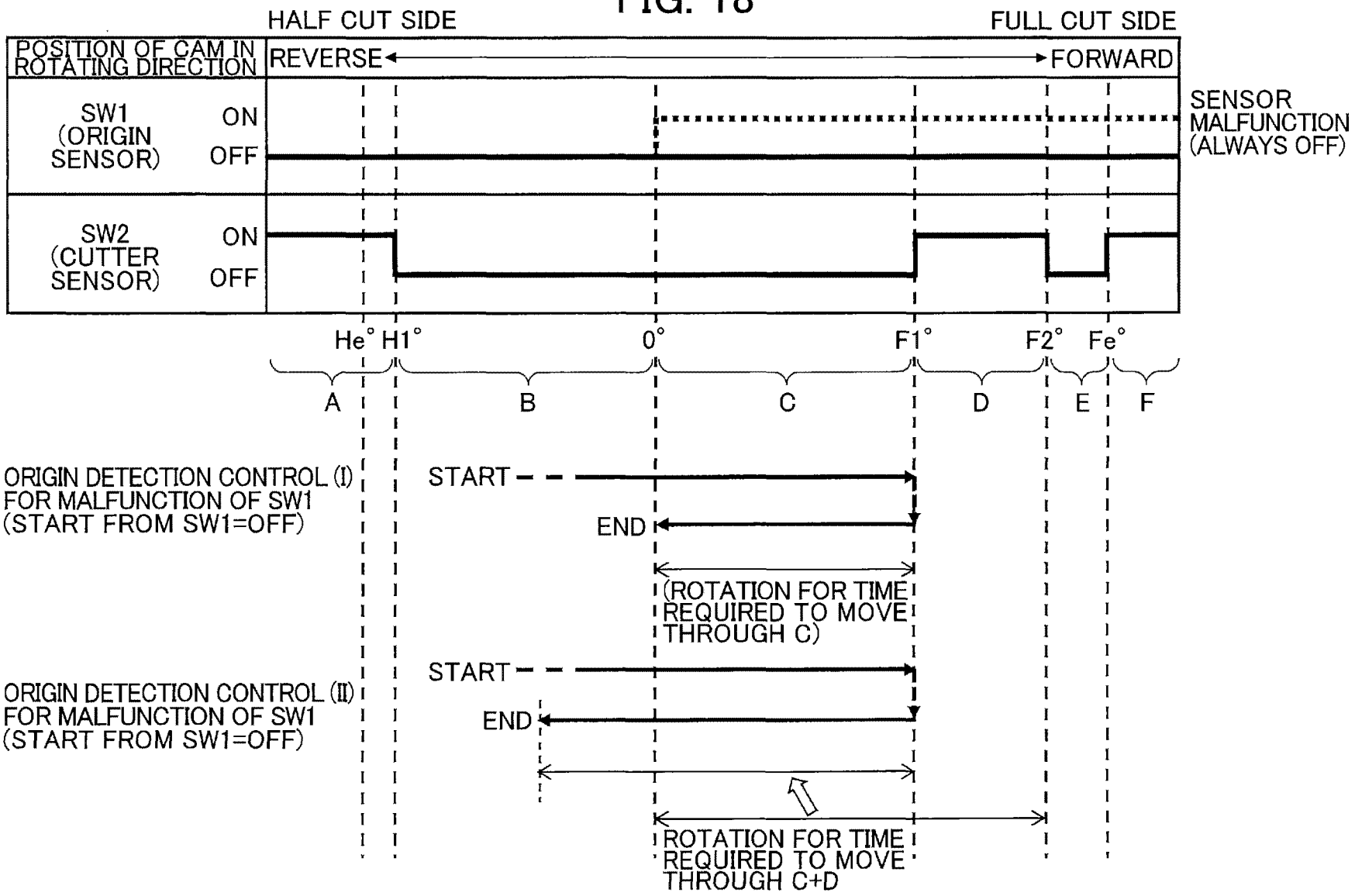
FIG. 18 is a view illustrating a control sequence in origin position detection control performed in the printing device in case of malfunction of the first detection sensor.

However, the CPU 21 in the present embodiment performs origin detection control incorporating control sequences based on detection results (the detection signal) from the second detection sensor SW2, as illustrated in FIG. 18. That is, as illustrated in the upper part of FIG. 18, the CPU 21 rotates the rotary cam 60 forward initially when beginning origin detection control and halts the forward rotation when the detection signal from the second detection sensor SW2 is switched from the OFF signal to the ON signal. This process enables the CPU 21 to detect the F1° position or Fe° position without referencing the first detection sensor SW1.

Assuming here that the CPU 21 detects the rotary cam 60 is in the F1° position, the CPU 21 rotates the rotary cam 60 in reverse for a known parameter of time required for moving the rotary cam 60 through region C. By this, it can be inferred that the rotary cam 60 has reached the origin position. This origin detection control will be called "first origin detection control (I)". Note that this description of the first origin detection control (I) and other origin detection control described below omits rotations for the braking time and the arbitrary set time illustrated in FIG. 16 and the above-described process of rotating the rotary cam 60 forward by the rotation amount corresponding to the arbitrary set time. The time period for which the rotary cam 60 is rotated in reverse in the first origin detection control (I) is an example of the claimed "prescribed period of time", also is an example of the claimed "first predetermined period of time", and further also is an example of the "third prescribed period of time".

As illustrated in the bottom part of FIG. 18, the time for rotating the rotary cam 60 in reverse from the F1° position described above may be set greater than or equal to the time required to move the rotary cam 60 through both regions C and D. This origin detection control will be called "second origin detection control (II)". With this control, even if the rotary cam 60 is rotated forward to the F2° position that denotes a full-cut state in a state where the first detection sensor SW1 malfunctions, the CPU 21 can return the rotary cam 60 to the origin position or to the reverse-rotation side of the origin position by rotating the rotary cam 60 in reverse for a known time required to pass through regions C and D. This time period for which the rotary cam 60 is rotated in reverse is an example of the claimed "prescribed period of time", also is an example of the claimed "first predetermined period of time", and further also is an example of the "third prescribed period of time".

Figure 19:
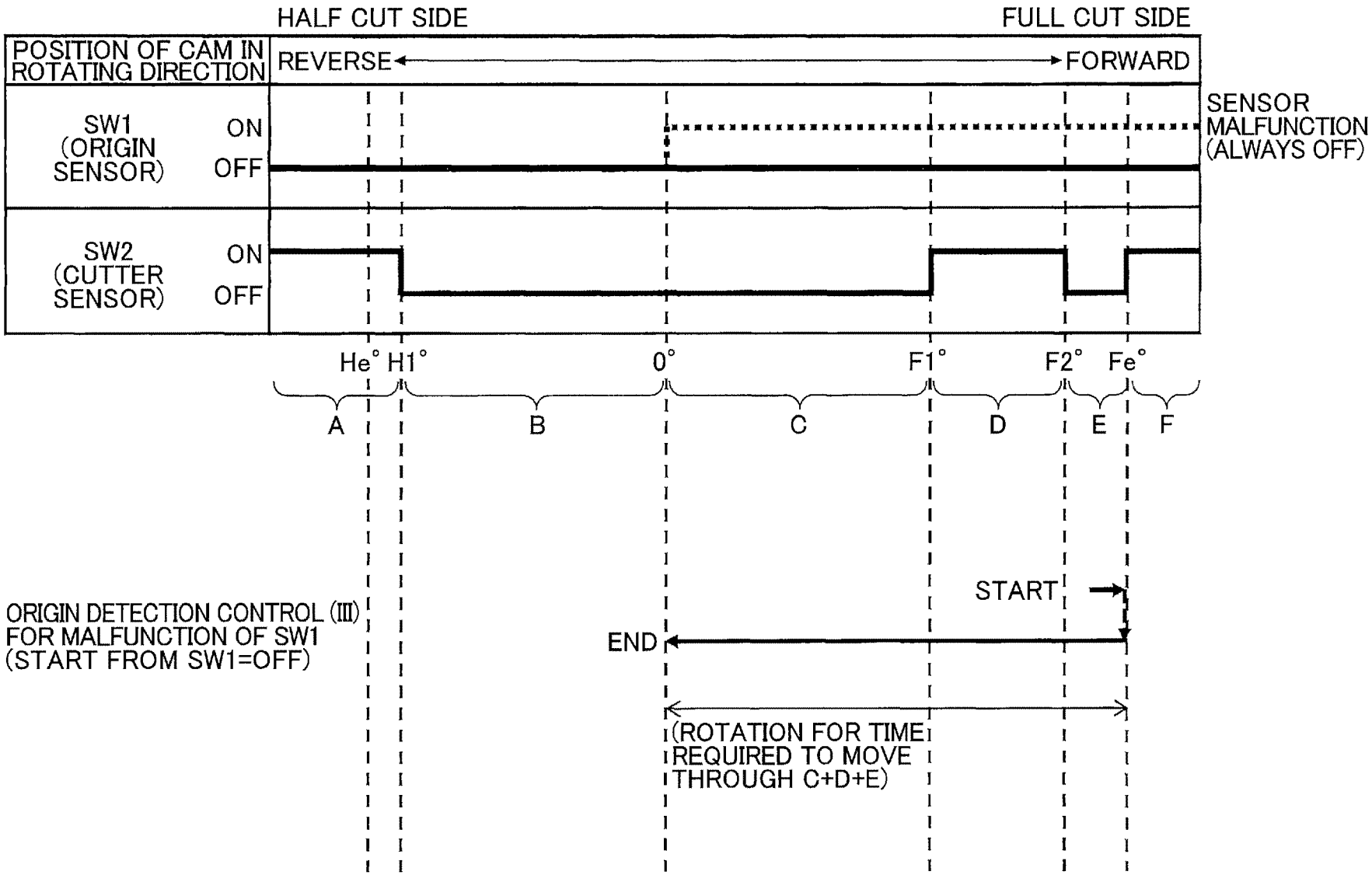
FIG. 19 is a view illustrating another control sequence in origin position detection control performed in the printing device in case of malfunction of the first detection sensor.

As described above, in the present embodiment, origin detection control is performed on the assumption that change in the detection signal of the second detection sensor SW2 from the OFF signal to the ON signal while the rotary cam 60 is rotating forward denotes that the rotary cam 60 arrives at the F1° position. However, as illustrated in FIG. 19, the CPU 21 may execute third origin detection control (III) on the assumption that change in the detection signal of the second detection sensor SW2 from the OFF signal to the ON signal while the rotary cam 60 is rotating forward denotes that the rotary cam 60 arrives at the Fe° position. With this control, if the CPU 21 detects that the rotary cam 60 is in the Fe° position after rotating the rotary cam 60 forward and halting the forward rotation when the detection signal from the second detection sensor SW2 has been switched from the OFF signal to the ON signal, the CPU 21 rotates the rotary cam 60 in reverse for a known parameter of time required for the rotary cam 60 to pass through regions C, D, and E. This time period for which the rotary cam 60 is rotated in reverse is an example of the claimed "prescribed period of time", also is an example of the claimed "first predetermined period of time", and further also is an example of the "third prescribed period of time".

Figure 20:
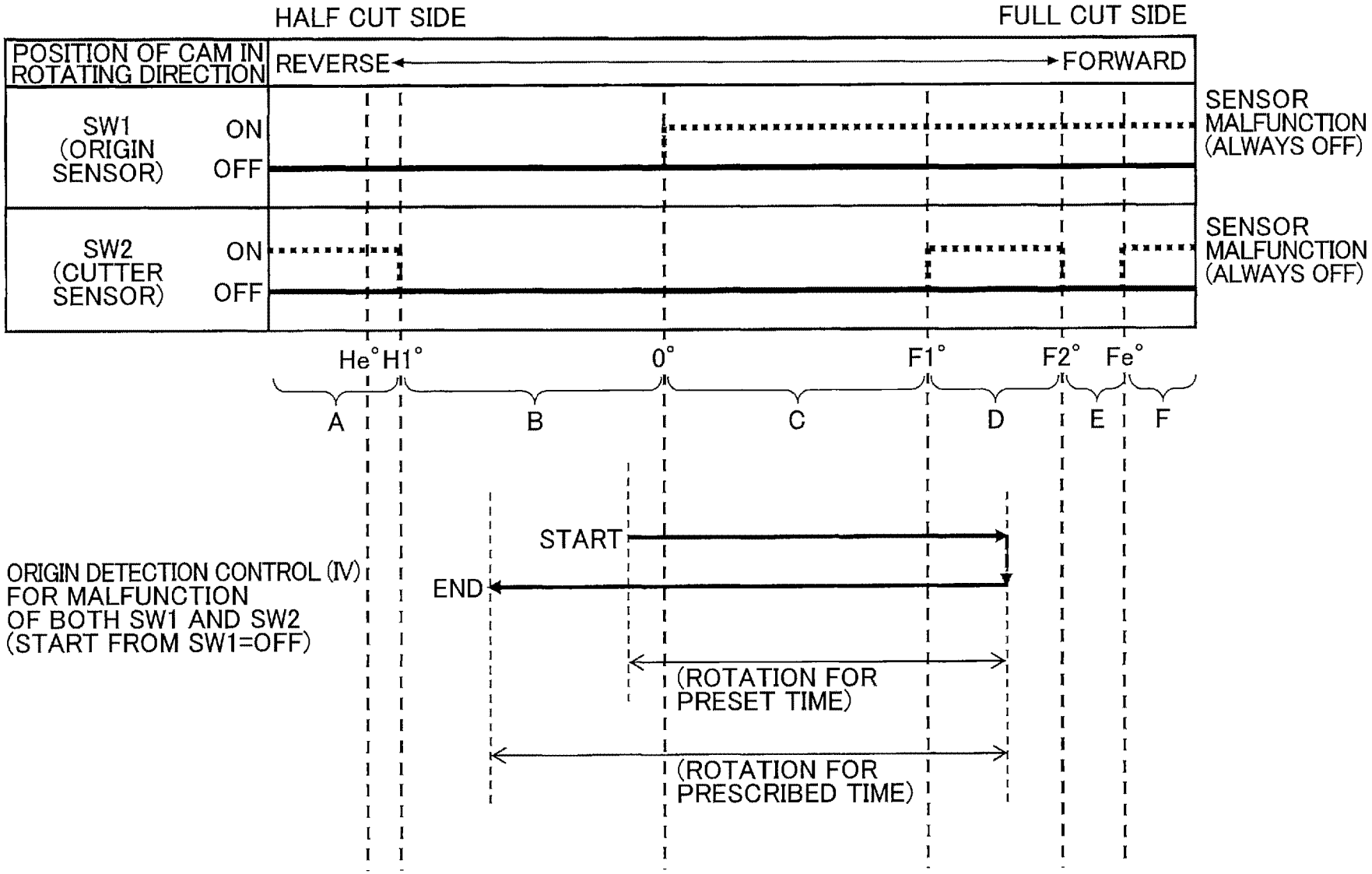
FIG. 20 is a view illustrating a control sequence in origin position detection control performed in the printing device in case of malfunction of both the first and second detection sensors.

Another possibility is that both detection sensors SW1 and SW2 malfunction. In such a case, the CPU 21 detects that the detection signals from the detection sensors SW1 and SW2 are the OFF signals at all rotated positions of the rotary cam 60. In this case, the CPU 21 executes fourth origin detection control (IV). In this control, as illustrated in FIG. 20, the CPU 21 rotates the rotary cam 60 forward when beginning the origin detection control. Then, the CPU 21 halts the rotary cam 60 after a preset time has elapsed, and subsequently rotates the rotary cam 60 in reverse for a prescribed time. In the present embodiment, this prescribed time is set to a period of time that is longer than or equal to the time required for the rotary cam 60 to pass through regions B and C. Through this fourth origin detection control (IV), the CPU 21 can reliably halt forward rotation of the rotary cam 60 before the rotary cam 60 rotates too far forward. The preset time in the fourth origin detection control (IV) is an example of the claimed "preset period of time". The prescribed time for which the rotary cam 60 is rotated in reverse in the fourth origin detection control (IV) is an example of the claimed "prescribed period of time" and also is an example of the claimed "second predetermined period of time".

Figure 21:
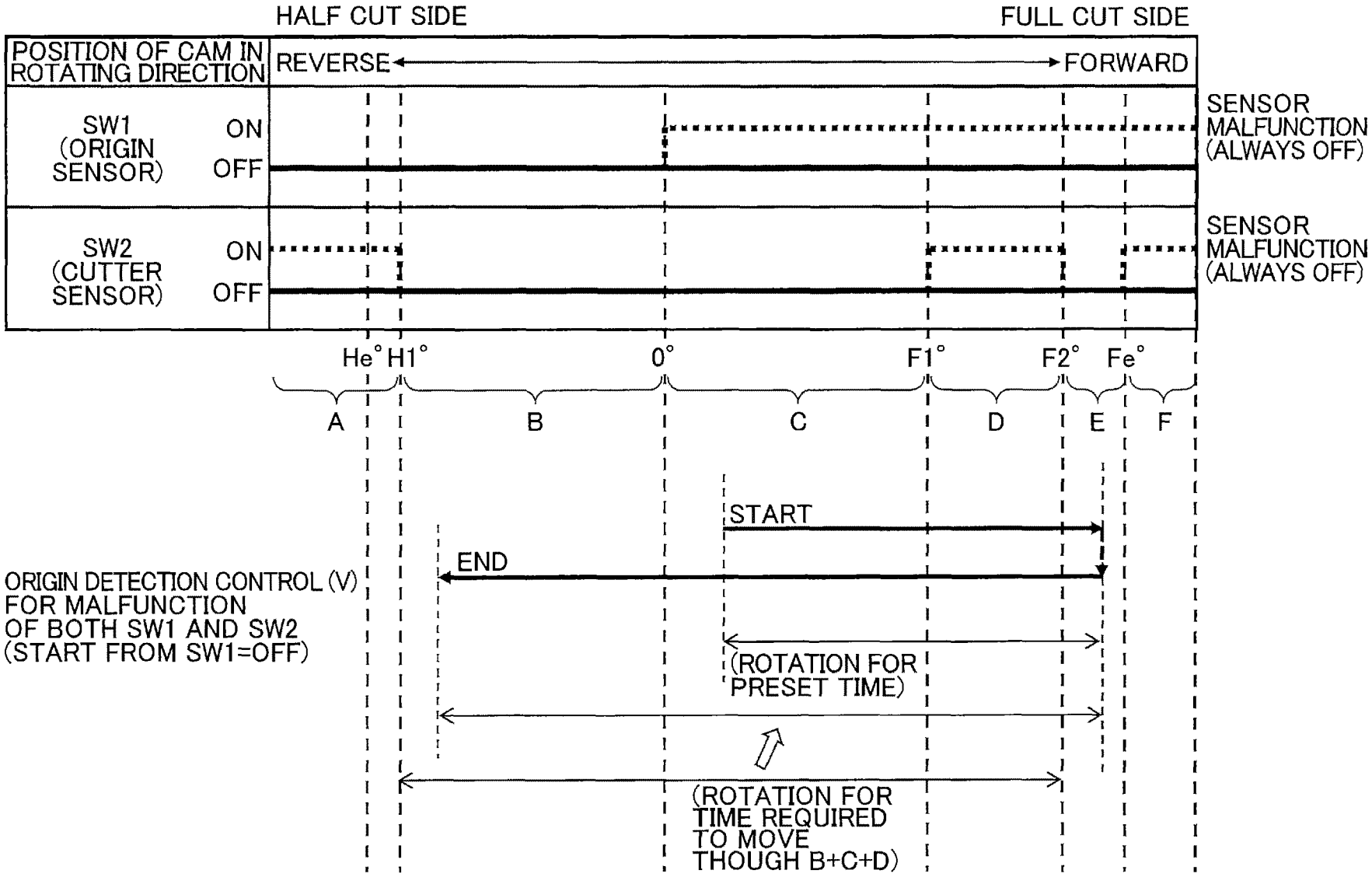
FIG. 21 is a view illustrating another control sequence in origin position detection control performed in the printing device in case of malfunction of both the first and second detection sensors.

As illustrated in FIG. 21, the reverse rotation time described above may be set greater than or equal to the time required for the rotary cam 60 to pass through regions B, C, and D. This will be called "fifth origin detection control (V)". Through this control, if the rotary cam 60 has been rotated forward until the rotary cam 60 is in the F2° position that denotes a full-cut state, the CPU 21 can return the rotary cam 60 to the reverse-rotation side of the origin position by rotating the rotary cam 60 in reverse for a known time required for the rotary cam 60 to pass through regions B, C, and D. The preset time in the fifth origin detection control (V) depicted in FIG. 21 is an example of the claimed "preset period of time". The time period for which the rotary cam 60 is rotated in reverse in the fifth origin detection control (V) is an example of the claimed "prescribed period of time" and also is an example of the claimed "second predetermined period of time".

<Control Process>

Figure 22:
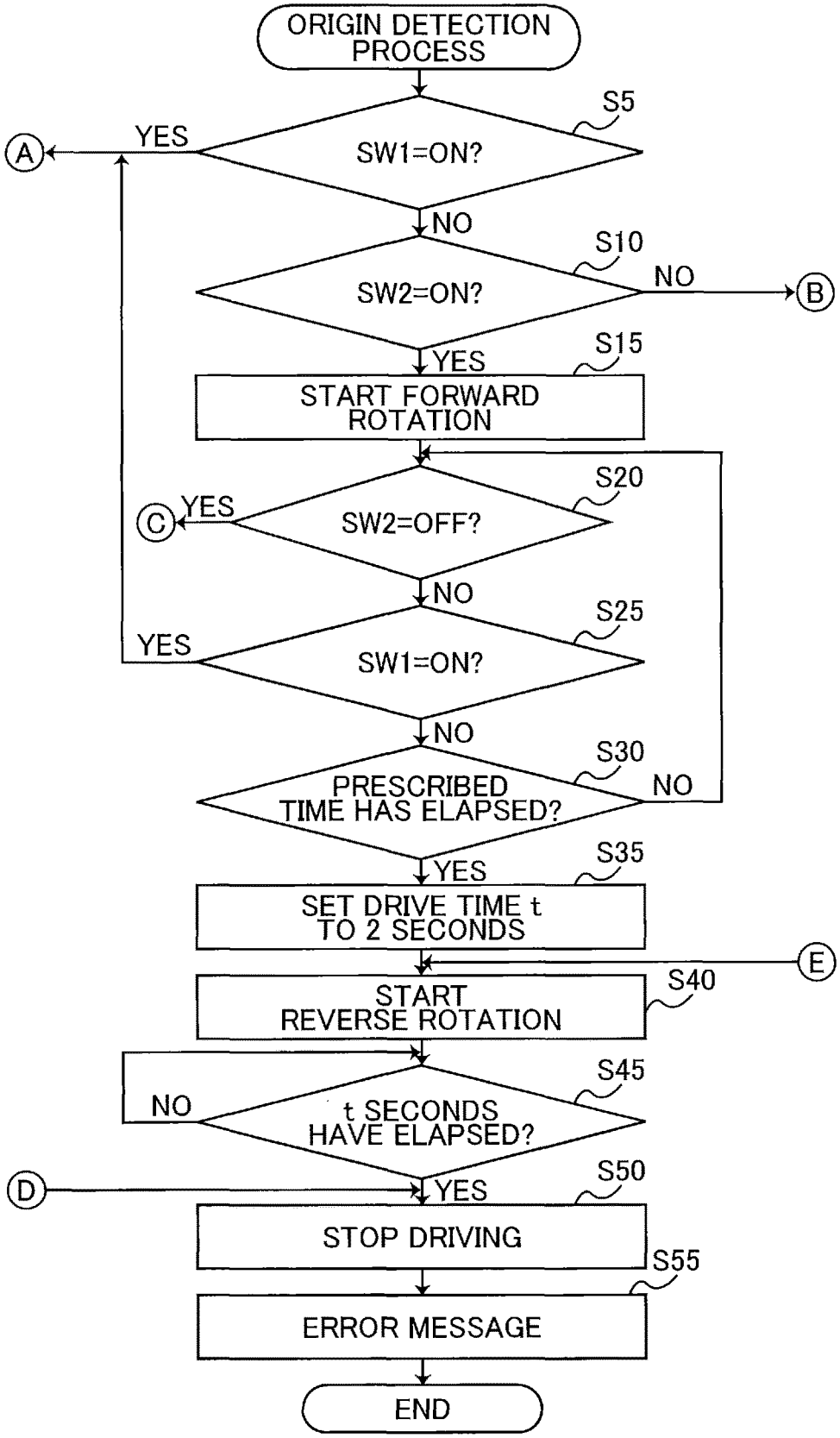
FIG. 22 is part of a flowchart illustrating steps performed in origin detection control.
Figure 23:
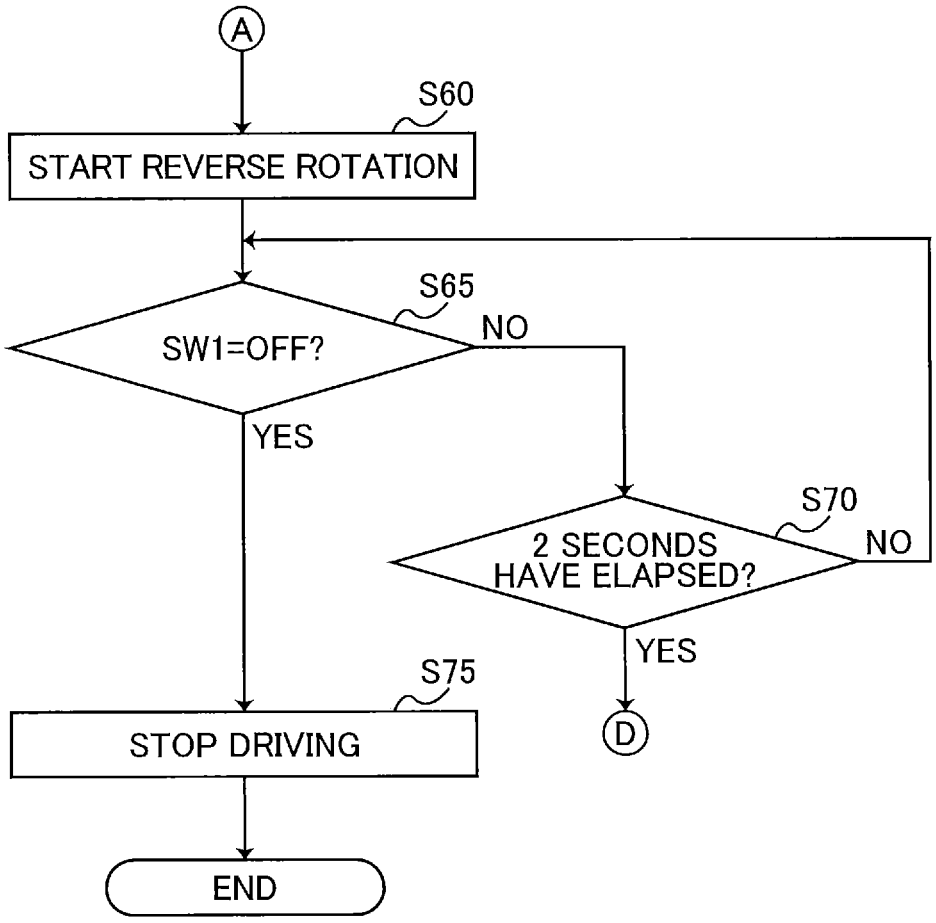
FIG. 23 is another part of the flowchart of the origin detection control.
Figure 24:
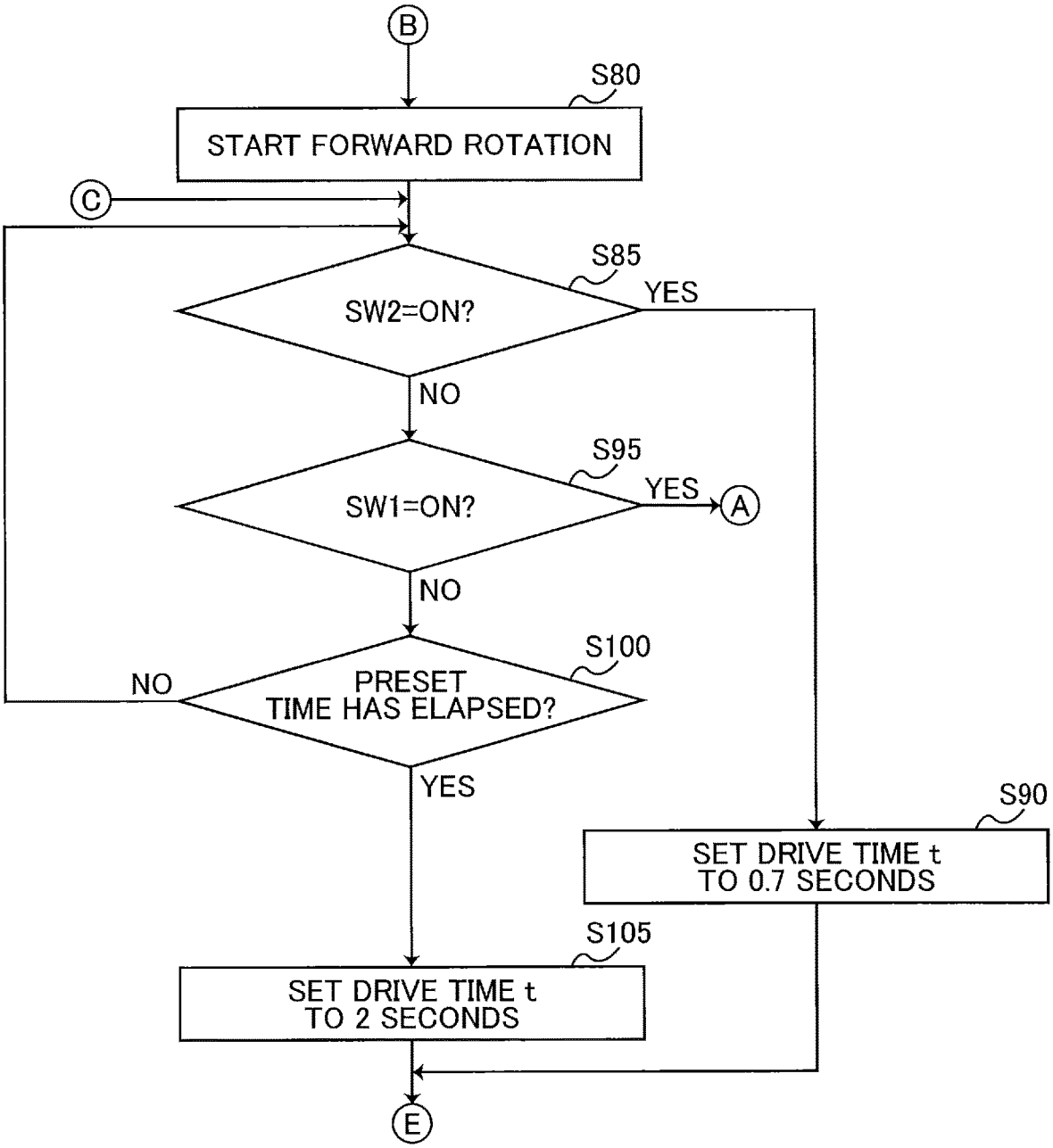
FIG. 24 is the other part of the flowchart of the origin detection control.

FIGS. 22 through 24 illustrate a control process executed by the CPU 21 of the printing device 1 to implement the origin detection process described above. In the example of the drawings, the process of FIG. 22 begins when the printing device 1 is turned on or reset.

In S5 at the beginning of the process, the CPU 21 determines whether the detection signal from the first detection sensor SW1 is the ON signal. When the CPU 21 determines that the detection signal from the first detection sensor SW1 is the ON signal (S5: YES), the CPU 21 advances to S60 of FIG. 23. In this case, at least the first detection sensor SW1 is considered to be in a normal state, i.e., not malfunctioning.

However, when the CPU 21 determines that the detection signal from the first detection sensor SW1 is the OFF signal, the CPU 21 advances to S10.

In S10 the CPU 21 determines whether the detection signal from the second detection sensor SW2 is the ON signal. When the CPU 21 determines that the detection signal from the second detection sensor SW2 is the OFF signal (S10: NO), the CPU 21 advances to S80 of FIG. 24.

However, when the CPU 21 determines that the detection signal from the second detection sensor SW2 is the ON signal (S10: YES), the CPU 21 advances to S15.

In S15 the CPU 21 begins rotating the rotary cam 60 forward.

In S20 the CPU 21 determines whether the detection signal from the second detection sensor SW2 has been switched to the OFF signal. When the CPU 21 determines that the detection signal from the second detection sensor SW2 has been switched to the OFF signal (S20: YES), the CPU 21 advances to S85 of FIG. 24.

However, when the CPU 21 determines that the detection signal from the second detection sensor SW2 remains the ON signal (S20: NO), the CPU 21 advances to S25.

In S25 the CPU 21 determines whether the detection signal from the first detection sensor SW1 has been switched to the ON signal. When the CPU 21 determines that the detection signal from the first detection sensor SW1 has been switched to the ON signal (S25: YES), the CPU 21 advances to S60 of FIG. 23.

However, when the CPU 21 determines that the detection signal from the first detection sensor SW1 remains the OFF signal (S25: NO), the CPU 21 advances to S30.

In S30 the CPU 21 determines whether a prescribed time has elapsed since the CPU 21 began rotating the rotary cam 60 forward in S15. When the CPU 21 determines that the prescribed time has not elapsed (S30: NO), the CPU 21 returns to S20 and repeats the process described above.

However, when the CPU 21 determines that the prescribed time has elapsed (S30: YES), the CPU 21 advances to S35.

In S35 the CPU 21 sets a drive time t to 2 seconds (2,000 ms).

In S40 the CPU 21 begins rotating the rotary cam 60 in reverse.

In S45 the CPU 21 continues rotating the rotary cam 60 in reverse while waiting in a loop for the drive time t to elapse after the reverse rotation is started in S40. In other words, the CPU 21 continuously loops back to S45 while the drive time t has not elapsed (S45: NO) and advances to S50 when the drive time t has elapsed (S45: YES).

In S50 the CPU 21 stops driving the rotary cam 60 to rotate.

In S55 the CPU 21 displays an error message on a display (not illustrated) indicating that at least one of the detection sensors SW1 and SW2 has malfunctioned, and subsequently ends the origin detection process.

Next, the flowchart in FIG. 23 will be described.

In S60 the CPU 21 begins rotating the rotary cam 60 in reverse.

In S65 the CPU 21 determines whether the detection signal from the first detection sensor SW1 has been switched to the OFF signal. When the CPU 21 determines that the detection signal from the first detection sensor SW1 remains the ON signal (S65: NO), the CPU 21 advances to S70.

In S70 the CPU 21 determines whether a 2-second time limit has elapsed since the CPU 21 began rotating the rotary cam 60 in reverse in S60. When the CPU 21 determines that 2 seconds have elapsed (S70: YES), the CPU 21 returns to S50 of FIG. 22.

However, when the CPU 21 determines that 2 seconds have not elapsed (S70: NO), the CPU 21 returns to S65 and repeats the process described above.

On the other hand, when the CPU 21 determines in S65 that the detection signal from the first detection sensor SW1 has been switched to the OFF signal (S65: YES), the CPU 21 advances to S75.

In S75 the CPU 21 stops driving the rotary cam 60 to rotate and ends the origin detection process.

Next, the process in FIG. 24 will be described.

In S80 the CPU 21 begins rotating the rotary cam 60 forward.

In S85 the CPU 21 determines whether the detection signal from the second detection sensor SW2 has been switched to the ON signal. When the CPU 21 determines that the detection signal from the second detection sensor SW2 has been switched to the ON signal (S85: YES), the CPU 21 advances to S90.

In S90 the CPU 21 halts the forward rotation of the rotary cam 60 and sets the drive time t to 0.7 seconds (700 ms). These 0.7 seconds are equivalent to the reverse rotation time in the first origin detection control (I) illustrated in FIG. 18, i.e., the amount of time for moving the rotary cam 60 through region C. Subsequently, the CPU 21 returns to S40 of FIG. 22.

On the other hand, when the CPU 21 determines in S85 that the detection signal from the second detection sensor SW2 remains the OFF signal (S85: NO), the CPU 21 advances to S95.

In S95 the CPU 21 determines whether the detection signal from the first detection sensor SW1 has been switched to the ON signal. When the CPU 21 determines that the detection signal from the first detection sensor SW1 has been switched to the ON signal (S95: YES), the CPU 21 returns to S60 of FIG. 23.

On the other hand, when the CPU 21 determines that the detection signal from the first detection sensor SW1 remains the OFF signal (S95: NO), the CPU 21 advances to S100.

In S100 the CPU 21 determines whether a preset time has elapsed since the CPU 21 begins rotating the rotary cam 60 forward in S80 or S15. This preset time corresponds to the preset time for forward rotation in the fourth origin detection control (IV) illustrated in FIG. 20. When the CPU 21 determines that the prescribed time has not elapsed (S100: NO), the CPU 21 returns to S85 and repeats the process described above.

On the other hand, when the CPU 21 determines that the prescribed time has elapsed (S100: YES), the CPU 21 advances to S105.

In S105 the CPU 21 halts the forward rotation of the rotary cam 60 and sets the drive time t to 2 seconds (2,000 ms) and subsequently returns to S40 of FIG. 22.

According to the flowcharts described above, the controller 20 performs origin detection control under a normal control sequence when neither of the detection sensors SW1 and SW2 has malfunctioned. Further, when the first detection sensor SW1 has malfunctioned, the CPU 21 executes the first origin detection control (I) using a reverse rotation time of 0.7 seconds, which are required for moving the rotary cam 60 through region C from the F1° position to the origin position.

<Effects of the Embodiment>

In the original detection process described above, the CPU 21 in the printing device 1 according to the embodiment performs a process configured of steps S80 to S90 and a process configured of steps S40 and S45. In the process of S80 to S90, when performing the positioning of the rotary cam 60 while rotating the same forward on the basis of detection results from the first detection sensor SW1, the CPU 21 halts this forward rotation based on detection results from the second detection sensor SW2. After halting the forward rotation, in the process of S40 and S45, the CPU 21 rotates the rotary cam 60 in the reverse direction (i.e., the direction opposite the previous rotating direction) for a prescribed period of time.

In this way, even if one of the detection sensors SW1 and SW2 malfunctions and does not output a proper detection signal, the CPU 21 can halt the rotary cam 60 at a suitable timing based on detection signals from the other sensor, thereby halting the rotary cam 60 before the rotary cam 60 rotates too far in the forward direction. Thereafter, the CPU 21 can rotate the rotary cam 60 in the reverse direction for a prescribed period of time. In this way, the CPU 21 can prevent the cutter motor 90 from continuing to apply a rotational drive force that could adversely affect the gear mechanism 35, thereby improving durability of the gear mechanism 35.

Further, a particular feature of the present embodiment is that the CPU 21 halts forward rotation of the rotary cam 60 in the process of S80 to S90 when the detection signal from the second detection sensor SW2 is switched to the ON signal while the detection signal from the first detection sensor SW1 remains the OFF signal, and subsequently in the process of S40 and S45 rotates the rotary cam 60 in the reverse direction for a predetermined prescribed period of time (0.7 seconds).

In the above-described embodiment, the CPU 21 halts forward rotation of the rotary cam 60 when the detection signal from the second detection sensor SW2 changes polarity, even when the first detection sensor SW1 has malfunctioned and its detection signal no longer changes polarity. Thus, the CPU 21 can reliably halt forward rotation of the rotary cam 60 before the rotary cam 60 rotates too far in the forward direction.

Another feature of the embodiment is that the movable blades 43 and 53 include the full-cutting edge 43*a* of the full cutter 40 for performing a full cut through the thickness direction of the tape 57, and the half-cutting edge 53*a* of the half cutter 50 for partially cutting through the tape 57 in its thickness direction. Both the full-cutting edge 43*a* and half-cutting edge 53*a* advance toward and retract from the tape 57 based on the rotation of the single rotary cam 60 driven by the rotational drive force of the single cutter motor 90.

In the above-described embodiment, the rotary cam 60 is rotated by the rotational drive force of the single cutter motor 90, and the full-cutting edge 43*a* and half-cutting edge 53*a* provided as movable blades both advance and retract based on this rotation of the rotary cam 60. In other words, the rotational drive force of the single cutter motor 90 can drive both the full-cutting edge 43*a* and half-cutting edge 53*a* to advance and retract, thereby requiring less layout space and manufacturing costs than when two motors are provided for driving the respective two cutting edges 43*a* and 53*a*.

Another feature of the embodiment is that the half-cutting edge 53*a* is configured to, in accordance with rotation of the rotary cam 60, move away from the tape 57 when the full-cutting edge 43*a* approaches the tape 57, and approach the tape 57 when the full-cutting edge 43*a* moves away from the tape 57.

In this way, the half-cutting edge 53*a* moves away from the tape 57 when the cutter motor 90 rotates to advance the full-cutting edge 43*a* toward the tape 57, and the full-cutting edge 43*a* moves away from the tape 57 when the cutter motor 90 rotates to advance the half-cutting edge 53*a* toward the tape 57. This arrangement can avoid conflicting operations of the full-cutting edge 43*a* and half-cutting edge 53*a* while the drive force of the single cutter motor 90 drives both the full-cutting edge 43*a* and half-cutting edge 53*a* to advance and retract.

Another feature of the embodiment is that the full-cutting edge 43*a* of the full cutter 40 is configured to approach the tape 57 by the rotary cam 60 rotating in the forward direction and to move away from the tape 57 by the rotary cam 60 rotating in the reverse direction. Similarly, the half-cutting edge 53*a* of the half cutter 50 is configured to approach the tape 57 by the rotary cam 60 rotating in the reverse direction and to move away from the tape 57 by the rotary cam 60 rotating in the forward direction.

Accordingly, by rotating the cutter motor 90 in a certain direction so that the rotary cam 60 is rotated in the forward direction, the full-cutting edge 43*a* can be advanced toward the tape 57 and the half-cutting edge 53*a* can be retracted from the tape 57. Similarly, by rotating the cutter motor 90 in the direction opposite the certain direction so that the rotary cam 60 is rotated in the reverse direction, the half-cutting edge 53*a* can be advanced toward the tape 57 while the full-cutting edge 43*a* can be retracted from the tape 57. Accordingly, the drive force of the single cutter motor 90 can reliably drive both the full-cutting edge 43*a* and half-cutting edge 53*a* to advance and retract.

Another feature of the embodiment is that the first detection sensor SW1 is an origin sensor (a reference rotated position sensor) capable of detecting arrival of the rotary cam 60 at the origin position in the rotating direction (the reference rotated position), and the second detection sensor SW2 is a cutter sensor (a progress sensor) capable of detecting the cutting progress of the movable blades 43 and 53 relative to the tape 57. Accordingly, even if the first detection sensor SW1 designed to be used in the origin detection process malfunctions, detection results from the second detection sensor SW2 can be used to halt rotation of the rotary cam 60 reliably before the rotary cam 60 rotates too far.

Another feature of the embodiment is that the reverse rotation time in the process of S40 and S45 is greater than or equal to the time required for the drive force of the cutter motor 90 to rotate the rotary cam 60 in reverse from the F1° position to the origin position. In the embodiment described above, the forward-rotation side of the origin position is the direction in which the full-cutting edge 43*a* of the full cutter 40 approaches the tape 57 for performing a full cut, while the reverse-rotation side of the origin position is the direction in which the half-cutting edge 53*a* of the half cutter 50 approaches the tape 57 for performing a partial cut, i.e., a half cut.

In the embodiment, the time for rotating the rotary cam 60 in reverse toward the origin position is set to a time greater than or equal to the drive time required for the rotary cam 60 to rotate from the F1° position to the origin position. Accordingly, even if the first detection sensor SW1 malfunctions and the rotary cam 60 is rotated in forward by the drive force of the cutter motor 90 to reach the F1° position, the rotary cam 60 can be returned to the origin position or a position on the reverse-rotation side of the origin position by the reverse rotation of the rotary cam 60.

Another feature of the embodiment is that in the process of S80 to S105 the CPU 21 halts forward rotation of the rotary cam 60 when the detection signal from the second detection sensor SW2 remains the OFF signal for a prescribed period of time and subsequently in the process of S40 and S45 rotates the rotary cam 60 in the reverse direction for a preset prescribed time (2 seconds).

Hence, forward rotation of the rotary cam 60 is halted, even when the second detection sensor SW2 malfunctions and cannot output a proper detection signal. Accordingly, the CPU 21 can reliably halt the rotary cam 60 before the rotary cam 60 rotates too far in the forward direction.

Another feature of the embodiment is that the reverse rotation time in the process of S40 and S45 is greater than or equal to the time required for the rotary cam 60 to be rotated from the F1° position to the H1° position.

In the embodiment described above, the forward-rotation side of the origin position is the direction in which the full-cutting edge 43*a* of the full cutter 40 approaches the tape 57, and the reverse-rotation side is the direction in which the half-cutting edge 53*a* of the half cutter 50 approaches the tape 57. In the embodiment, the reverse rotation time is set greater than or equal to the time for rotating the rotary cam 60 from the F1° position to the H1° position. Accordingly, if the first detection sensor SW1 malfunctions and the rotary cam 60 is rotated to the F1° position by forward rotation of the cutter motor 90, the CPU 21 can return the rotary cam 60 to a position corresponding to the start timing of the half cut on the reverse-rotation side of the origin position by rotating the rotary cam 60 in the reverse direction for the reverse rotation time.

Note that the specific modes described above, such as the forward and reverse rotational directions of the rotary cam 60, handling of the full cutter 40 and half cutter 50, arrangement of the detection sensors SW1 and SW2, ON/OFF polarities, and normally-off/normally-on properties may be set to other modes and are not limited to the examples in the embodiment.

The use of such terms as "perpendicular," "parallel," and "flat" in the above description are not intended to be taken in their strictest sense. In other words, the terms "perpendicular," "parallel," and "flat" may signify "substantially perpendicular," "substantially parallel," and "substantially flat" to allow for design and manufacturing tolerances and error.

When dimensions and sizes are described as being "identical," "equivalent," or "different" in appearance in the above description, these terms are not intended to be taken in their strictest sense. In other words, the terms "identical," "equivalent," and "different" may signify "substantially identical," "substantially equivalent," and "substantially different" to allow for design and manufacturing tolerances and error. However, when describing values used for prescribed criteria or values for divisions, such as threshold values (see the flowcharts in FIGS. 22, 23, and 24) or reference values, such terms as "identical," "equivalent," and "different" should be taken in their strictest sense.

The arrows in FIG. 14 and other drawings indicate examples of signal flow in the above description, but the directions of signal flow are not limited to these examples.

Further, the flowcharts illustrated in FIGS. 22, 23, 24, and the like do not limit the present disclosure to the steps indicated therein. Steps may be added or deleted, or their order may be rearranged, without departing from the spirit and technical ideas of the disclosure.

In addition to what has already been described, the methods according to the embodiment and its variations described above may be used in suitable combinations.

In addition, although not illustrated individually, the present disclosure may be implemented with various modifications without departing from the spirit of the disclosure.

What is claimed is:

1. A printing device comprising:

a printing unit configured to print on a printing tape conveyed along a conveying path;

a motor configured to generate a rotational drive force;

a rotary body rotatable both in a first rotating direction and a second rotating direction opposite to the first rotating direction, the rotary body being configured to be rotated by the rotational drive force generated by the motor, the rotary body including a first portion and a second portion;

one or more movable blades configured to advance and retract relative to the printing tape on the conveying path in accordance with rotation of the rotary body to cut at least part of the printing tape;

a gear mechanism provided on a power transmission path of the rotational drive force from the motor to the one or more movable blades to transmit the rotational drive force;

a first detector configured to contact and separate from the first portion of the rotary body in accordance with the rotation of the rotary body to output a detection signal based on a rotated position of the rotary body;

a second detector configured to contact and separate from the second portion of the rotary body in accordance with the rotation of the rotary body to output a detection signal based on the rotated position of the rotary body;

a controller configured to perform, by controlling the motor, positioning the rotary body to a predetermined reference rotated position on the basis of the detection signals from both the first detector and the second detector, the positioning including:

(a) starting rotating the rotary body in the first rotating direction on the basis of the detection signal from one detector of the first detector and the second detector at the time of starting the positioning;

(b) halting the rotation in the first rotating direction of the rotary body on the basis of the detection signal from the other detector of the first detector and the second detector; and (c) rotating the rotary body in the second rotating direction for a prescribed period of time after the rotation in the first rotating direction of the rotary body is halted by the halting in (b).

2. The printing device according to claim 1, wherein the detection signal from each of the first detector and the second detector is configured to change polarity of the detection signal between a first polarity and a second polarity on the basis of the rotated position of the rotary body, wherein, in response to detecting change in the polarity of the detection signal from the other detector without detecting change in the polarity of the detection signal from the one detector after the rotation in the first rotating direction of the rotary body is started by the starting in (a), the halting in (b) is performed and the prescribed period of time is set to a first predetermined period of time.

3. The printing device according to claim 2, wherein the one or more movable blades include:

a full-cut blade for performing a full cut of fully cutting the printing tape in a thickness direction thereof; and a half-cut blade for performing a half cut of partially cutting the printing tape in the thickness direction thereof, and wherein both the full-cut blade and the half-cut blade advance and retract relative to the printing tape in accordance with the rotation of the single rotary body driven by the rotational drive force of the single motor.

4. The printing device according to claim 3, wherein the full-cut blade is configured to, in accordance with the rotation of the rotary body:

approach the printing tape when the half-cut blade moves away from the printing tape; and move away from the printing tape when the half-cut blade approaches the printing tape, and wherein the half-cut blade is configured to, in accordance with the rotation of the rotary body:

approach the printing tape when the full-cut blade moves away from the printing tape; and move away from the printing tape when the full-cut blade approaches the printing tape.

5. The printing device according to claim 4, wherein the full-cut blade is configured to:

approach the printing tape when the rotary body rotates in the first rotating direction; and move away from the printing tape when the rotary body rotates in the second rotating direction, and wherein the half-cut blade is configured to:

approach the printing tape when the rotary body rotates in the second rotating direction; and move away from the printing tape when the rotary body rotates in the first rotating direction.

6. The printing device according to claim 3, wherein the one detector is a reference rotated position sensor for detecting arrival of the rotary body at the predetermined reference rotated position, wherein the other detector is a progress sensor for detecting cutting progress of the one or more movable blades with respect to the printing tape.

7. The printing device according to claim 3, wherein the first predetermined period of time is greater than or equal to a period of time required for the rotary body to be rotated by the rotational drive force of the motor from a first specific rotated position to the predetermined reference rotated position, the first specific rotated position being the rotated position that corresponds to a full-cut start timing at which the full cut with respect to the printing tape is started by the full-cut blade.

8. The printing device according to claim 3, wherein, in response to the polarity of the detection signal from the other detector being unchanged for a preset period of time after the rotation in the first rotating direction of the rotary body is started by the starting in (a), the halting in (b) is performed and the prescribed period of time is set to a second predetermined period of time.

9. The printing device according to claim 8, wherein the second predetermined period of time is greater than or equal to a period of time required for the rotary body to be rotated by the rotational drive force of the motor from a first specific rotated position to a second specific rotated position, the first specific rotated position being the rotated position that corresponds to a full-cut start timing at which the full cut with respect to the printing tape is started by the full-cut blade, the second specific rotated position being the rotated position that corresponds to a half-cut start timing at which the half cut with respect to the printing tape is started by the half-cut blade.

* * * * *